US006740482B1

(12) United States Patent
Chen et al.

(10) Patent No.: US 6,740,482 B1
(45) Date of Patent: May 25, 2004

(54) HIGH CHLORIDE EMULSION HAVING HIGH SENSITIVITY AND LOW FOG

(75) Inventors: Benjamin Teh-Kung Chen, Penfield, NY (US); Roger Lok, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 08/362,107

(22) Filed: Dec. 22, 1994

(51) Int. Cl.[7] ..... G03C 1/005; G03C 1/494
(52) U.S. Cl. ..... 430/567; 430/603; 430/611
(58) Field of Search ..... 430/567, 603, 430/611

(56) References Cited

U.S. PATENT DOCUMENTS

| | | | | | |
|---|---|---|---|---|---|
| 4,269,927 | A | * | 5/1981 | Atwell | 430/567 |
| 4,960,689 | A | | 10/1990 | Nishikawa et al. | 430/567 |
| 5,009,992 | A | | 4/1991 | Friedrich et al. | 430/573 |
| 5,079,138 | A | | 1/1992 | Takada | 430/567 |
| 5,110,719 | A | * | 5/1992 | Shuto et al. | 430/567 |
| 5,229,263 | A | | 7/1993 | Yoshida et al. | 430/567 |
| 5,244,781 | A | | 9/1993 | Takada | 430/567 |
| 5,292,635 | A | * | 3/1994 | Lok | 430/603 |
| 5,314,798 | A | * | 5/1994 | Brust et al. | 430/569 |
| 5,389,508 | A | * | 2/1995 | Takada et al. | 430/567 |
| 5,399,479 | A | * | 3/1995 | Lok | 430/567 |
| 5,411,855 | A | * | 5/1995 | MacIntyre et al. | 430/567 |
| 5,726,005 | A | * | 3/1998 | Chen et al. | 430/567 |
| 5,736,310 | A | * | 4/1998 | Chen et al. | 430/567 |

FOREIGN PATENT DOCUMENTS

| | | | |
|---|---|---|---|
| EP | 0 421 452 | 4/1991 | |
| EP | 0 495 253 | 7/1992 | |
| EP | 0 543 403 | 5/1993 | |
| JP | 1-304448 | * 12/1989 | 430/567 |
| JP | 3-84545 | 4/1991 | |
| JP | 3208041 | 9/1991 | |
| WO | WO 92/12462 | 7/1992 | |

OTHER PUBLICATIONS

Abstract (JP 4,122,923), Apr. 23, 1992.
Abstract (JP 5,107,670), Apr. 30, 1993.
Derwent Abstract, vol. 15, No. 262, p. 1222, Jul. 3, 1991 (JP 3–84545).

* cited by examiner

*Primary Examiner*—Geraldine Letscher
(74) *Attorney, Agent, or Firm*—Paul A. Leipold; Lynne M. Blank

(57) ABSTRACT

The invention provides a radiation sensitive emulsion comprised of a dispersing medium and silver iodochloride grains WHEREIN the silver iodochloride grains are partially bounded by {100} crystal faces satisfying the relative orientation and spacing of cubic grains and contain from 0.05 to 1 mole percent iodide, based on total silver, with maximum iodide concentrations located nearer the surface of the grains than their center and wherein said emulsion further comprises a thiosulfonate of Formula I and a sulfinate of Formula II wherein Formula I is $$Z_1SO_2SM_1 \quad (I)$$

wherein $Z_1$ is alkyl, aryl, heteroaryl, arylalkyl, substituted aryl or a polymeric backbone wherein the thiosulfonate group is repeated and $M_1$ is a monovalent metal or a tetraalkylammonium cation, and Formula II is $$Z_2SO_2M_2 \quad (II)$$

wherein $Z_2$ is alkyl, aryl, heteroaryl, arylalkyl, substituted aryl or a polymeric backbone wherein the sulfinate group is repeated and $M_2$ is a monovalent metal or a tetraalkylammonium cation.

15 Claims, No Drawings

HIGH CHLORIDE EMULSION HAVING HIGH SENSITIVITY AND LOW FOG

FIELD OF THE INVENTION

The invention relates to color photographic emulsions particularly those comprising tetradecahedral silver chloride iodide grains comprising less than 5 mole % iodide.

BACKGROUND OF THE INVENTION

In the manufacturing of color negative photographic printing papers, at least three light sensitive emulsion layers are used to capture the photographic image, i.e., red, green, and blue. Frequently, the blue sensitive emulsion is placed at the bottom of the light sensitive multilayer coating pack. In this layering order, less light is available to the bottom blue layer because of the light scattering and absorption occuring in the layers above.

The incandescent lamp used for exposing the paper is low in its energy output in the short wavelength region (blue) of the visible spectra. This further reduces the energy impinging on the blue layer.

The color negative film through which the light is exposed onto the photographic paper has a yellowish brown tint (as a result of the processing used for development). This yellowish background filters out blue light causing a further diminution of blue light arriving at the bottom layer.

Still, in recent developments in the art of manufacturing color photographic paper, there is a need to improve the color reproduction of the original scene as captured in the color negative film. One way of achieving such an improvement is to employ a shorter blue spectral sensitizing dye that better matches the blue sensitization of the original film (U.S. Ser. No. 245,336 filed May 18, 1994). As a result, the sensitivity of the blue emulsion is further pushed towards the shorter wavelength region where less light energy is available.

Consequently, there exists a need to manufacture a blue sensitive emulsion that has a high sensitivity (speed) in order to overcome the light deficiency and to capture the fidelity of the original color image.

Photofinishers also desire short processing times in order to increase the output of color prints. One way of increasing output is to accelerate the development by increasing the chloride content of the emulsions; the higher the chloride content, the higher the development rate. Furthermore, the release of chloride ion into the developing solution has less restraining action on development compared to bromide, thus allowing developing solutions to be utilized in a manner that reduces the amount of waste developing solution.

Additionally, it is highly desirable that color negative printing papers have speed characteristics that are invariant with exposure time. This feature allows their usage in a wide variety of applications, including high speed printers, easel printing, and other electronic printing devices. To accommodate this variety of exposing devices, the emulsions used in the color negative papers must be capable of recording the exposure between the exposure range of nanoseconds ($1\times10^{-9}$ seconds) to several minutes while maintaining printing speed and contrast. But emulsions with high-chloride content are usually less efficient, with relative efficiency being worse at high intensity-short time exposures. Therefore, there is a need for high-chloride emulsions with high sensitivity that exhibit little loss in speed at extremely short exposure times.

Another factor to be considered when designing a color paper is print quality such that it is pleasing to the eye both in color and contrast. A color paper with high contrast gives saturated colors and rich details in shadow areas.

It is known in the art that the greater reducibility and developability of silver chloride relative to silver bromide or iodide emulsions make silver chloride emulsion highly susceptible to fog formation. Thus, it is extremely critical when using silver chloride emulsions of high sensitivity that this fog be restrained.

It is also known in the art that when fog is generated in the precipitation stage, certain agents can be added during the grain-forming process to reduce the undesirable minute silver clusters that constitute this fog. These agents include hydrogen peroxide, peroxy acid salts, disulfides (U.S. Pat. No. 3,397,986), mercury compounds (U.S. Pat. No. 2,728,664), iodine (EP 576,920), iodide releasing agents (EP 563,708, EP 562,476, EP 561,415, and JP 06,011,784) and p-quinone (U.S. Pat. No. 3,957,490).

The use of thiosulfonate compounds for controlling fog during precipitation has been claimed in the following U.S. patents: U.S. Pat. Nos. 5,061,614; 5,079,138; 5,244,781; 5,185,241; and 5,229,263. Likewise, in the following European applications, EP 368,304; EP 434,012; EP 435,355; and EP 435,270, the use of thiosulfonates during grain formation of AgX emulsions is claimed.

For high chloride emulsions, U.S. Pat. No. 4,960,689 discloses the use of thiosulfonates in the finish. It also claims the use of thiosulfonates in combination with sensitizing dyes in high chloride emulsions. Aromatic thiosulfonic acids are disclosed in U.S. Pat. No. 5,009,992 as supersensitizers in an IR-sensitive high Cl emulsion. EP 495,253 discloses the use of thiosulfonates in the sensitization of high chloride emulsions along with Au(III) and thiocyanate salts.

Combination of thiosulfonates with sulfinates and nucleating agents are taught to be useful in U.S. Pat. No. 5,110,719 in a direct positive internal latent image core/shell ClBr emulsion. U.S. Pat. No. 5,292,635 discloses the use of thiosulfonates and sulfinates in controlling speed increase on incubation of color photographic materials. The combination of thiosulfonates with sulfinates has been alleged to be useful in the sensitization of chloride emulsions for color paper in JP 3,208,041. U.S. Pat. No. 2,394,198 discloses the use of sulfinates with thiosulfonates in stabilizing silver halide emulsions. U.S. Pat. No. 2,440,206 teaches the use of the combination of sulfinates, along with small amounts of polythionic acids to stabilize photographic emulsions against fog growth. U.S. Pat. No. 2,440,110 teaches the use of the combination of sulfinates with aromatic or heterocyclic polysulfides in controlling fog growth. A combination of iodate ions and sulfinates have been claimed by Fuji to be useful in preventing yellow fog in silver halide materials. The use of sulfinates has been disclosed to reduce stain in photographic paper when used in combination with sulfonates in US Statutory Invention Registration H706, and in EP 305,926.

Alkyl and aryl disulfinates have been disclosed for use in the formation pre-fogged direct positive silver halide emulsions in U.S. Pat. No. 5,043,259. U.S. Pat. No. 4,939,072 discloses the use of sulfinates as storage stability improving compounds in color photographs. In U.S. Pat. No. 4,770,987 sulfinates are disclosed as anti-staining agents, along with a magenta coupler in silver halide materials. EP 463,639 teaches the use of sulfinic acid derivatives as dye stabilizers. The use of a paper base which has been treated with a sulfinic acid salt has been disclosed in U.S. Pat. No. 4,410, 619 to prevent discoloration of the photographic material. Aromatic sulfinates are alleged to be useful as stabilizers in a direct positive photographic material in U.S. Pat. No. 3,466,173. In EP 267,483, sulfinates are added during the sensitization of silver bromide emulsions. Similarly, G.B. 1,308,938 alleges the use of sulfinates during processing of a silver halide photographic material to minimize discoloration of the image tone. Sulfinates are claimed to have fog reducing properties in U.S. Pat. No. 2,057,764.

PROBLEM TO BE SOLVED BY THE INVENTION

There is a continuing need for high chloride emulsions that have improved sensitivity. Further, there is a need for emulsions that will provide higher contrast when utilized in photographic elements. Further, there is a continuing need for improved finishing materials to provide increased sensitivity without fog increase to new iodochloride grain types.

SUMMARY OF THE INVENTION

The object of the present invention is to provide a photosensitive material that can be rapidly processed.

Another object of the invention is to provide a color negative photographic element with high sensitivity.

Still another object of the invention is to provide a color negative reflection print photosensitive material of improved contrast density.

A further object of the invention is to produce color prints with little change in speed when exposed for a very short duration.

A still further object of the invention is to produce color prints with low fog.

These and other objects of this invention are generally accomplished by a radiation sensitive emulsion comprised of a dispersing medium and silver iodochloride grains Wherein the silver iodochloride grains are partially bounded by {100} crystal faces satisfying the relative orientation and spacing of cubic grains and contain from 0.05 to 1 mole percent iodide, based on total silver, with maximum iodide concentrations located nearer the surface of the grains than their center and wherein said emulsion further comprises a thiosulfonate of Formula I and a sulfinate of Formula II wherein Formula I is $$Z_1SO_2SM_1 \quad (I)$$

wherein $Z_1$ is alkyl, aryl, heteroaryl, arylalkyl, substituted aryl or a polymeric backbone wherein the thiosulfonate group is repeated and $M_1$ is a monovalent metal or a tetraalkylammonium cation, and Formula II is $$Z_2SO_2M_2 \quad (II)$$

wherein $Z_2$ is alkyl, aryl, heteroaryl, arylalkyl, substituted aryl or a polymeric backbone wherein the thiosulfonate group is repeated and $M_2$ is a monovalent metal or a tetraalkylammonium cation.

ADVANTAGEOUS EFFORT OF THE INVENTION

The invention has an advantage of providing improved sensitivity and fog in the high chloride tetrahedral emulsions. The invention further provides improved contrast in photographic elements utilizing the emulsions of the invention.

DETAILED DESCRIPTION OF THE INVENTION

The emulsions of the invention are cubical grain high chloride emulsions suitable for use in photographic print elements. Whereas those preparing high chloride emulsions for print elements have previously relied upon bromide incorporation for achieving enhanced sensitivity and have sought to minimize iodide incorporation, the emulsions of the present invention contain cubical silver iodochloride grains. The silver iodochloride cubical grain emulsions of the invention exhibit higher sensitivities than previously employed silver bromochloride cubical grain emulsions. This is attributable to the iodide incorporation within the grains and, more specifically, the placement of the iodide within the grains.

It has been recognized for the first time that heretofore unattained levels of sensitivity can be realized by low levels of iodide, in the range of from 0.05 to 1 (preferably 0.1 to 0.6) mole percent iodide, based on total silver, nonuniformly distributed within the grains. Specifically, a maximum iodide concentration is located within the cubical grains nearer the surface of the grains than their center. Preferably, the maximum iodide concentration is located in the exterior portions of the grains accounting for up to 15 percent of total silver.

Limiting the overall iodide concentrations within the cubical grains maintains the known rapid processing rates and ecological compatibilities of high chloride emulsions. Maximizing local iodide concentrations within the grains maximizes crystal lattice variances. Since iodide ions are much larger than chloride ions, the crystal cell dimensions of silver iodide are much larger than those of silver chloride. For example, the crystal lattice constant of silver iodide is 5.0 Å compared to 3.6 Å for silver chloride. Thus, locally increasing iodide concentrations within the grains locally increases crystal lattice variances and, provided the crystal lattice variances are properly located, photographic sensitivity is increased.

Since overall iodide concentrations must be limited to retain the known advantages of high chloride grain structures, it is preferred that all of the iodide be located in the region of the grain structure in which maximum iodide concentration occurs. Broadly then, iodide can be confined to the last precipitated (i.e., exterior) 50 percent of the grain structure, based on total silver precipitated. Preferably, iodide is confined to the exterior 15 percent of the grain structure, based on total silver precipitated.

The maximum iodide concentration can occur adjacent the surface of the grains, but, to reduce minimum density, it is preferred to locate the maximum iodide concentration within the interior of the cubical grains.

The preparation of cubical grain silver iodochloride emulsions with iodide placements that produce increased photographic sensitivity can be undertaken by employing any convenient conventional high chloride cubical grain precipitation procedure prior to precipitating the region of maximum iodide concentration, that is, through the introduction of at least the first 50 (preferably at least the first 85) percent of silver precipitation. The initially formed high chloride cubical grains then serve as hosts for further grain growth. In one specifically contemplated preferred form, the host emulsion is a monodisperse silver chloride cubic grain emulsion. Low levels of iodide and/or bromide, consistent with the overall composition requirements of the grains, can also be tolerated within the host grains. The host grains can include other cubical forms, such as tetradecahedral forms. Techniques for forming emulsions satisfying the host grain requirements of the preparation process are well known in the art. For example, prior to growth of the maximum iodide concentration region of the grains, the precipitation procedures of Atwell U.S. Pat. No. 4,269,927, Tanaka EPO 0 080 905, Hasebe et al U.S. Pat. No. 4,865,962, Asami EPO 0 295 439, Suzumoto et al U.S. Pat. No. 5,252,454 or Ohshima et al U.S. Pat. No. 5,252,456, the disclosures of which are here incorporated by reference, can be employed, but with those portions of the preparation procedures, when present, that place bromide ion at or near the surface of the grains being omitted. Stated another way, the host grains can be prepared employing the precipitation procedures taught by the citations above through the precipitation of the highest chloride concentration regions of the grains without the presence of bromide and achieve the same or higher sensitivity.

Once a host grain population has been prepared accounting for at least 50 percent (preferably at least 85 percent) of total silver has been precipitated, an increased concentration of iodide is introduced into the emulsion to form the region of the grains containing a maximum iodide concentration. The iodide ion is preferably introduced as a soluble salt, such as an ammonium or alkali metal iodide salt. The iodide ion can be introduced concurrently with the addition of silver and/or chloride ion. Alternatively, the iodide ion can be introduced alone followed promptly by silver ion introduction with or without further chloride ion introduction. It is preferred to grow the maximum iodide concentration region on the surface of the host grains rather than to introduce a maximum iodide concentration region exclusively by displacing chloride ion adjacent the surfaces of the host grains.

To maximize the localization of crystal lattice variances produced by iodide incorporation it is preferred that the iodide ion be introduced as rapidly as possible. That is, the iodide ion forming the maximum iodide concentration region of the grains is preferably introduced in less than 30 seconds, optimally in less than 10 second. When the iodide is introduced more slowly, somewhat higher amounts of iodide (but still within the ranges set out above) are required to achieve speed increases equal to those obtained by more rapid iodide introduction and minimum density levels are somewhat higher. Slower iodide additions are manipulatively simpler to accomplish, particularly in larger batch size emulsion preparations. Hence, adding iodide over a period of at least 1 minute (preferably at least 2 minutes) and, preferably, during the concurrent introduction of silver is specifically contemplated.

It has been observed that when iodide is added more slowly, preferably over a span of at least 1 minute (preferably at least 2 minutes) and in a concentration of greater than 5 mole percent, based the concentration of silver concurrently added, the advantage can be realized of decreasing grain-to-grain variances in the emulsion. For example, well defined tetradecahedral grains have been prepared when iodide is introduced more slowly and maintained above the stated concentration level. It is believed that at concentrations of greater than 5 mole percent the iodide is acting to promote the emergence of {1111} crystal faces. Any iodide concentration level can be employed up to the saturation level of iodide in silver chloride, typically about 13 mole percent. Increasing iodide concentrations above their saturation level in silver chloride runs the risk of precipitating a separate silver iodide phase. Maskasky U.S. Pat. No. 5,288,603, here incorporated by reference, discusses iodide saturation levels in silver chloride.

Further grain growth following precipitation of the maximum iodide concentration region is not essential, but is preferred to separate the maximum iodide region from the grain surfaces, as previously indicated. Growth onto the grains containing iodide can be conducted employing any one of the conventional procedures available for host grain precipitation.

The localized crystal lattice variances produced by growth of the maximum iodide concentration region of the grains preclude the grains from assuming a cubic shape, even when the host grains are carefully selected to be monodisperse cubic grains. Instead, the grains are cubical, but not cubic. That is, they are only partly bounded by {100} crystal faces. When the maximum iodide concentration region of the grains is grown with efficient stirring of the dispersing medium—i.e., with uniform availability of iodide ion, grain populations have been observed that consist essentially of tetradecahedral grains. However, in larger volume precipitations in which the same uniformities of iodide distribution cannot be achieved, the grains have been observed to contain varied departures from a cubic shape. Usually shape modifications ranging from the presence of from one to the eight {111} crystal faces of tetradecahedra have been observed. In other cubical grains one or more portions of the grain surfaces are bounded by crystal faces other than {100} crystal faces, but identification of their crystal lattice orientation has not been undertaken.

After examining the performance of emulsions exhibiting varied cubical grain shapes, it has been concluded that the performance of these emulsions is principally determined by iodide incorporation and the uniformity of grain size dispersity. The silver iodochloride grains are relatively monodisperse. The silver iodochloride grains preferably exhibit a grain size coefficient of variation of less than 35 percent and optimally less than 25 percent. Much lower grain size coefficients of variation can be realized, but progressively smaller incremental advantages are realized as dispersity is minimized. The silver halide emulsions employed in the elements of this invention generally are negative-working.

In the course of grain precipitation one or more dopants (grain occlusions other than silver and halide) can be introduced to modify grain properties. For example, any of the various conventional dopants disclosed in *Research Disclosure*, Vol. 365, September 1994, Item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

In one preferred form of the invention it is specifically contemplated to incorporate in the face centered cubic crystal lattice of the grains a dopant capable of increasing photographic speed by forming a shallow electron trap (hereinafter also referred to as a SET). When a photon is absorbed by a grain, an electron (hereinafter referred to as a photoelectron) is promoted from the valence band of the silver halide crystal lattice to its conduction band, creating a hole (hereinafter referred to as a photohole) in the valence band. To create a latent image site within the grain, a plurality of photoelectrons produced in a single imagewise exposure must reduce several silver ions in the crystal lattice to form a small cluster of Ago atoms. To the extent that photoelectrons are dissipated by competing mechanisms before the latent image can form, the photographic sensitivity of the silver halide grains is reduced. For example, if the photoelectron returns to the photohole, its energy is dissipated without contributing to latent image formation.

It is contemplated to dope the grain to create within it shallow electron traps that contribute to utilizing photoelectrons for latent image formation with greater efficiency. This is achieved by incorporating in the face centered cubic crystal lattice a dopant that exhibits a net valence more positive than the net valence of the ion or ions it displaces in the crystal lattice. For example, in the simplest possible form the dopant can be a polyvalent (+2 to +5) metal ion that displaces silver ion ($Ag^+$) in the crystal lattice structure. The substitution of a divalent cation, for example, for the monovalent $Ag^+$ cation leaves the crystal lattice with a local net positive charge. This lowers the energy of the conduction band locally. The amount by which the local energy of the conduction band is lowered can be estimated by applying the effective mass approximation as described by J. F. Hamilton in the journal *Advances in Physics*, Vol. 37 (1988) p. 395 and *Excitonic Processes in Solids* by M. Ueta, H. Kanzaki, K. Kobayashi, Y. Toyozawa and E. Hanamura (1986), published by Springer-Verlag, Berlin, p. 359. If a silver chloride crystal lattice structure receives a net positive charge of +1 by doping, the energy of its conduction band is lowered in the vicinity of the dopant by about 0.048 electron volts (eV). For a net positive charge of +2 the shift is about 0.192 eV.

When photoelectrons are generated by the absorption of light, they are attracted by the net positive charge at the dopant site and temporarily held (i.e., bound or trapped) at the dopant site with a binding energy that is equal to the local decrease in the conduction band energy. The dopant that causes the localized bending of the conduction band to a lower energy is referred to as a shallow electron trap because the binding energy holding the photoelectron at the dopant site (trap) is insufficient to hold the electron permanently at the dopant site. Nevertheless, shallow electron trapping sites are useful. For example, a large burst of photoelectrons generated by a high intensity exposure can be held briefly in shallow electron traps to protect them against immediate dissipation while still allowing their efficient migration over a period of time to latent image forming sites.

For a dopant to be useful in forming a shallow electron trap it must satisfy additional criteria beyond simply providing a net valence more positive than the net valence of the ion or ions it displaces in the crystal lattice. When a dopant is incorporated into the silver halide crystal lattice, it creates in the vicinity of the dopant new electron energy levels (orbitals) in addition to those energy levels or orbitals which comprised the silver halide valence and conduction bands. For a dopant to be useful as a shallow electron trap it must satisfy these additional criteria: (1) its highest energy electron occupied molecular orbital (HOMO, also commonly referred to as the frontier orbital) must be filled—e.g., if the orbital will hold two electrons (the maximum possible number), it must contain two electrons and not one and (2) its lowest energy unoccupied molecular orbital (LUMO) must be at a higher energy level than the lowest energy level conduction band of the silver halide crystal lattice. If conditions (1) and/or (2) are not satisfied, there will be a local, dopant-derived orbital in the crystal lattice (either an unfilled HOMO or a LUMO) at a lower energy than the local, dopant-induced conduction band minimum energy, and photoelectrons will preferentially be held at this lower energy site and thus impede the efficient migration of photoelectrons to latent image forming sites.

Metal ions satisfying criteria (1) and (2) are the following: Group 2 metal ions with a valence of +2, Group 3 metal ions with a valence of +3 but excluding the rare earth elements 58–71, which do not satisfy criterion (1), Group 12 metal ions with a valence of +2 (but excluding Hg, which is a strong desensitizer, possibly because of spontaneous reversion to $Hg^{+1}$), Group 13 metal ions with a valence of +3, Group 14 metal ions with a valence of +2 or +4 and Group 15 metal ions with a valence of +3 or +5. Of the metal ions satisfying criteria (1) and (2) those preferred on the basis of practical convenience for incorporation as dopants include the following period 4, 5 and 6 elements: lanthanum, zinc, cadmium, gallium, indium, thallium, germanium, tin, lead and bismuth. Specifically preferred metal ion dopants satisfying criteria (1) and (2) for use in forming shallow electron traps are zinc, cadmium, indium, lead and bismuth. Specific examples of shallow electron trap dopants of these types are provided by DeWitt U.S. Pat. No. 2,628,167, Gilman et al U.S. Pat. No. 3,761,267, Atwell et al U.S. Pat. No. 4,269,527, Weyde et al U.S. Pat. No. 4,413,055 and Murakima et al EPO 0 590 674 and 0 563 946.

Metal ions in Groups 8, 9 and 10 (hereinafter collectively referred to as Group VIII metal ions) that have their frontier orbitals filled, thereby satisfying criterion (1), have also been investigated. These are Group 8 metal ions with a valence of +2, Group 9 metal ions with a valence of +3 and Group 10 metal ions with a valence of +4. It has been observed that these metal ions are incapable of forming efficient shallow electron traps when incorporated as bare metal ion dopants. This is attributed to the LUMO lying at an energy level below the lowest energy level conduction band of the silver halide crystal lattice.

However, coordination complexes of these Group VIII metal ions as well as $Ga^{+3}$ and $In^{+3}$, when employed as dopants, can form efficient shallow electron traps. The requirement of the frontier orbital of the metal ion being filled satisfies criterion (1). For criterion (2) to be satisfied at least one of the ligands forming the coordination complex must be more strongly electron withdrawing than halide (i.e., more electron withdrawing than a fluoride ion, which is the most highly electron withdrawing halide ion).

One common way of assessing electron withdrawing characteristics is by reference to the spectrochemical series of ligands, derived from the absorption spectra of metal ion complexes in solution, referenced in *Inorganic Chemistry: Principles of Structure and Reactivity*, by James E. Huheey, 1972, Harper and Row, New York and in *Absorption Spectra and Chemical Bonding in Complexes* by C. K. Jorgensen, 1962, Pergamon Press, London. From these references the following order of ligands in the spectrochemical series is apparent:

$$I^- < Br^- < S^{-2} < SCN^- < Cl^- < NO_3^- < F^- < OH < H_2O < NCS^- < CH_3CN^- < NH_3 < NO_2^- << CN^- < CO.$$

The spectrochemical series places the ligands in sequence in their electron withdrawing properties, the first ($I^-$) ligand in the series is the least electron withdrawing and the last (CO) ligand being the most electron withdrawing. The underlining indicates the site of ligand bonding to the polyvalent metal ion.

The efficiency of a ligand in raising the LUMO value of the dopant complex increases as the ligand atom bound to the metal changes from Cl to S to O to N to C. Thus, the ligands $CN^-$ and CO are especially preferred. Other preferred ligands are thiocyanate ($NCS^-$), seleno-cyanate ($NCSe^{31}$), cyanate ($NCO^{31}$), tellurocyanate ($NCTe^-$) and azide ($N_3^-$).

Just as the spectrochemical series can be applied to ligands of coordination complexes, it can also be applied to the metal ions. The following spectrochemical series of metal ions is reported in *Absorption Spectra and Chemical Bonding* by C. K. Jorgensen, 1962, Pergamon Press, London:

$$Mn^{+2}<Ni^{+2}<Co^{+2}<Fe^{+2}<Cr^{+3}>>V^{+3}<Co^{+3}<Mn^{+4}<Mo^{+3}<Rh^{+3}>>Ru^{+2}<Pd^{+4}<Ir^{+3}<Pt^{+4}$$

The metal ions in boldface type satisfy frontier orbital requirement (1) above. Although this listing does not contain all the metals ions which are specifically contemplated for use in coordination complexes as dopants, the position of the remaining metals in the spectrochemical series can be identified by noting that an ion's position in the series shifts from $Mn^{+2}$, the least electronegative metal, toward $Pt^{+4}$, the most electronegative metal, as the ion's place in the Periodic Table of Elements increases from period 4 to period 5 to period 6. The series position also shifts in the same direction when the positive charge increases. Thus, $Os^{+3}$, a period 6 ion, is more electronegative than $Pd^{+4}$, the most electronegative period 5 ion, but less electronegative than $Pt^{+4}$, the most electronegative period 6 ion.

From the discussion above $Rh^{+3}$, $Ru^{+3}$, $Pd^{+41}$ $Ir^{+3}$, $Os^{+3}$ and $Pt^{+4}$ are clearly the most electronegative metal ions satisfying frontier orbital requirement (1) above and are therefore specifically preferred.

To satisfy the LUMO requirements of criterion (2) above the filled frontier orbital polyvalent metal ions of Group VIII are incorporated in a coordination complex containing ligands, at least one, most preferably at least 3, and optimally at least 4 of which are more electronegative than halide, with any remaining ligand or ligands being a halide ligand. When the metal ion is itself highly electronegative, such $Os^{+3}$, only a single strongly electronegative ligand, such as carbonyl, for example, is required to satisfy LUMO requirements. If the metal ion is itself of relatively low electronegativity, such as $Fe^{+2}$, choosing all of the ligands to be highly electronegative may be required to satisfy LUMO requirements. For example, $Fe(II)(CN)_6$ is a specifically preferred shallow electron trapping dopant. In fact, coordination complexes containing 6 cyano ligands in general represent a convenient, preferred class of shallow electron trapping dopants.

Since $Ga^{+3}$ and $In^{+3}$ are capable of satisfying HOMO and LUMO requirements as bare metal ions, when they are incorporated in coordination complexes they can contain ligands that range in electronegativity from halide ions to any of the more electronegative ligands useful with Group VIII metal ion coordination complexes.

For Group VIII metal ions and ligands of intermediate levels of electronegativity it can be readily determined whether a particular metal coordination complex contains the proper combination of metal and ligand electronegativity to satisfy LUMO requirements and hence act as a shallow electron trap. This can be done by employing electron paramagnetic resonance (EPR) spectroscopy. This analytical technique is widely used as an analytical method and is described in *Electron Spin Resonance: A Comprehensive Treatise on Experimental Techniques*, 2nd Ed., by Charles P. Poole, Jr. (1983) published by John Wiley & Sons, Inc., New York.

Photoelectrons in shallow electron traps give rise to an EPR signal very similar to that observed for photoelectrons in the conduction band energy levels of the silver halide crystal lattice. EPR signals from either shallow trapped electrons or conduction band electrons are referred to as electron EPR signals. Electron EPR signals are commonly characterized by a parameter called the g factor. The method for calculating the g factor of an EPR signal is given by C. P. Poole, cited above. The g factor of the electron EPR signal in the silver halide crystal lattice depends on the type of halide ion(s) in the vicinity of the electron. Thus, as reported by R. S. Eachus, M. T. Olm, R. Janes and M. C. R. Symons in the journal *Physica Status Solidi* (*b*), Vol. 152 (1989), pp. 583–592, in a AgCl crystal the g factor of the electron EPR signal is 1.88±0.01 and in AgBr it is 1.49±0.02.

A coordination complex dopant can be identified as useful in forming shallow electron traps in silver halide emulsions if, in the test emulsion set out below, it enhances the magnitude of the electron EPR signal by at least 20 percent compared to the corresponding undoped control emulsion.

For a high chloride (>50 M %) emulsion the undoped control is a 0.34±0.05 mm edge length AgCl cubic emulsion prepared, but not spectrally sensitized, as follows: A reaction vessel containing 5.7 L of a 3.95% by weight gelatin solution is adjusted to 46° C., pH of 5.8 and a pAg of 7.51 by addition of a NaCl solution. A solution of 1.2 grams of 1,8-dihydroxy-3,6-dithiaoctane in 50 mL of water is then added to the reaction vessel. A 2 M solution of $AgNO_3$ and a 2 M solution of NaCl are simultaneously run into the reaction vessel with rapid stirring, each at a flow rate of 249 mL/min with controlled pAg of 7.51. The double-jet precipitation is continued for 21.5 minutes, after which the emulsion is cooled to 38° C., washed to a pAg of 7.26, and then concentrated. Additional gelatin is introduced to achieve 43.4 grams of gelatin/Ag mole, and the emulsion is adjusted to pH of 5.7 and pAg of 7.50. The resulting silver chloride emulsion has a cubic grain morphology and a 0.34 mm average edge length. The dopant to be tested is dissolved in the NaCl solution or, if the dopant is not stable in that solution, the dopant is introduced from aqueous solution via a third jet.

After precipitation, the test and control emulsions are each prepared for electron EPR signal measurement by first centrifuging the liquid emulsion, removing the supernatant, replacing the supernatant with an equivalent amount of warm distilled water and resuspending the emulsion. This procedure is repeated three times, and, after the final centrifuge step, the resulting powder is air dried. These procedures are performed under safe light conditions.

The EPR test is run by cooling three different samples of each emulsion to 20, 40 and 60° K., respectively, exposing each sample to the filtered output of a 200 W Hg lamp at a wavelength of 365 nm (preferably 400 nm for AgBr or AgIBr emulsions), and measuring the EPR electron signal during exposure. If, at any of the selected observation temperatures, the intensity of the electron EPR signal is significantly enhanced (i.e., measurably increased above signal noise) in the doped test emulsion sample relative to the undoped control emulsion, the dopant is a shallow electron trap.

As a specific example of a test conducted as described above, when a commonly used shallow electron trapping dopant, $Fe(CN)_6^{4-}$, was added during precipitation at a molar concentration of $50\times10^{-6}$ dopant per silver mole as described above, the electron EPR signal intensity was enhanced by a factor of 8 over undoped control emulsion when examined at 20° K.

Hexacoordination complexes are useful coordination complexes for forming shallow electron trapping sites. They contain a metal ion and six ligands that displace a silver ion and six adjacent halide ions in the crystal lattice. One or two of the coordination sites can be occupied by neutral ligands, such as carbonyl, aquo or ammine ligands, but the remainder of the ligands must be anionic to facilitate efficient incorporation of the coordination complex in the crystal lattice structure. Illustrations of specifically contemplated hexacoordination complexes for inclusion are provided by McDugle et al U.S. Pat. No. 5,037,732, Marchetti et al U.S. Pat. Nos. 4,937,180, 5,264,336 and 5,268,264, Keevert et al U.S. Pat. No. 4,945,035 and Murakami et al Japanese Patent Application Hei-2[1990]-249588.

In a specific form it is contemplated to employ as a SET dopant a hexacoordination complex satisfying the formula:

$$[ML_6]^n \quad \text{(I)}$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six coordination complex ligands which can be independently selected, provided that least four of the ligands are anionic ligands and at least one (preferably at least 3 and optimally at least 4) of the ligands is more electronegative than any halide ligand; and n is −1, −2, −3 or −4.

The following are specific illustrations of dopants capable of providing shallow electron traps:

SET-1 $[Fe(CN)_6]^{-4}$
SET-2 $[Ru(CN)_6]^{-4}$
SET-3 $[Os(CN)_6]^{-4}$
SET-4 $[Rh(CN)_6]^{-3}$
SET-5 $[Ir(CN)_6]^{-3}$
SET-6 $[Fe(pyrazine)(CN)_5]^{-4}$
SET-7 $[RuCl(CN)_5]^{-4}$
SET-8 $[OsBr(CN)_5]^{-4}$
SET-9 $[RhF(CN)_5]^{-3}$
SET-10 $[IrBr(CN)_5]^{-3}$
SET-11 $[FeCO(CN)_5]^{-3}$
SET-12 $[RuF_2(CN)_4]^{-4}$
SET-13 $[OsCl_2(CN)_4]^{-4}$
SET-14 $[RhI_2(CN)_4]^{-3}$
SET-15 $[IrBr_2(CN)_4]^{-3}$
SET-16 $[Ru(CN)_5(OCN)]^{-4}$
SET-17 $[Ru(CN)_5(N_3)]^{-4}$
SET-18 $[Os(CN)_5(SCN)]^{-4}$
SET-19 $[Rh(CN)_5(SeCN)]^{-3}$
SET-20 $[Ir(CN)_5(HOH)]^{-2}$
SET-21 $[Fe(CN)_3Cl_3]^{-3}$
SET-22 $[Ru(CO)_2(CN)_4]^{-1}$
SET-23 $[Os(CN)Cl_5]^{-4}$
SET-24 $[Co(CN)_6]^{-3}$
SET-25 $[Ir(CN)_4(oxalate)]^{-3}$
SET-26 $[In(NCS)_6]^{-3}$
SET-27 $[Ga(NCS)_6]^{-3}$
SET-28 $[Pt(CN)_4(H_2O)_2]^{-1}$ Instead of employing hexacoordination complexes containing $Ir^{+3}$, it is preferred to employ $Ir^{+4}$ coordination complexes. These can, for example, be identical to any one of the iridium complexes listed above, except that the net valence is −2 instead of −3. Analysis has revealed that $Ir^{+4}$ complexes introduced during grain precipitation are actually incorporated as $Ir^{+3}$ complexes. Analyses of iridium doped grains have never revealed $Ir^{+4}$ as an incorporated ion. The advantage of employing $Ir^{+4}$ complexes is that they are more stable under the holding conditions encountered prior to emulsion precipitation. This is discussed by Leubner et al U.S. Pat. No. 4,902,611, here incorporated by reference.

The SET dopants are effective at any location within the grains. Generally better results are obtained when the SET dopant is incorporated in the exterior 50 percent of the grain, based on silver. To insure that the dopant is in fact incorporated in the grain structure and not merely associated with the surface of the grain, it is preferred to introduce the SET dopant prior to forming the maximum iodide concentration region of the grain. Thus, an optimum grain region for SET incorporation is that formed by silver ranging from 50 to 85 percent of total silver forming the grains. That is, SET introduction is optimally commenced after 50 percent of total silver has been introduced and optimally completed by the time 85 percent of total silver has precipitated. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

The exposure (E) of a photographic element is the product of the intensity (I) of exposure multiplied by its duration (t):

$$E=I\times t \quad \text{(II)}$$

According to the photographic law of reciprocity, a photographic element should produce the same image with the same exposure, even though exposure intensity and time are varied. For example, an exposure for 1 second at a selected intensity should produce exactly the same result as an exposure of 2 seconds at half the selected intensity. When photographic performance is noted to diverge from the reciprocity law, this is known as reciprocity failure.

When exposure times are reduced below one second to very short intervals (e.g., $10^{-5}$ second or less), higher exposure intensities must be employed to compensate for the reduced exposure times. High intensity reciprocity failure (hereinafter also referred to as HIRF) occurs when photographic performance is noted to depart from the reciprocity law when varied exposure times of less than 1 second are employed.

SET dopants are also known to be effective to reduce HIRF. However, as demonstrated in the Examples below, it is an advantage of the invention that the emulsions of the invention show unexpectedly low levels of high intensity reciprocity failure even in the absence of dopants.

Iridium dopants that are ineffective to provide shallow electron traps—e.g., either bare iridium ions or iridium coordination complexes that fail to satisfy the more electropositive than halide ligand criterion of formula I above can be incorporated in the iodochloride grains of the invention to reduce low intensity reciprocity failure (hereinafter also referred to as LIRF). Low intensity reciprocity failure is the term applied to observed departures from the reciprocity law of photographic elements exposed at varied times ranging from 1 second to 10 seconds, 100 seconds or longer time intervals with exposure intensity sufficiently reduced to maintain an unvaried level of exposure.

The same Ir dopants that are effective to reduce LIRF are also effective to reduce variations latent image keeping (hereinafter also referred to as LIK). Photographic elements are sometimes exposed and immediately processed to produce an image. At other times a period of time can elapse between exposure and processing. The ideal is for the same photographic element structure to produce the same image independent of the elapsed time between exposure and processing.

The LIRF and/or LIK improving Ir dopant can be introduced into the silver iodochloride grain structure as a bare metal ion or as a non-SET coordination complex, typically a hexahalocoordination complex. In either event, the iridium ion displaces a silver ion in the crystal lattice structure. When the metal ion is introduced as a hexacoordination complex, the ligands need not be limited to halide ligands. The ligands are selected as previously described in connection with formula I, except that the incorporation of ligands more electropositive than halide is restricted so that the coordination complex is not capable of acting as a shallow electron trapping site.

To be effective for LIRF and/or LIK the Ir must be incorporated within the silver iodochloride grain structure. To insure total incorporation it is preferred that Ir dopant introduction be complete by the time 99 percent of the total silver has been precipitate. For LIRF improvement the Ir dopant can present at any location within the grain structure. For LIK improvement the Ir dopant must be introduced following precipitation of at least 60 percent of the total silver. Thus, a preferred location within the grain structure for Ir dopants, for both LIRF and LIK improvement, is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally LIRF and LIK dopants are contemplated to be incorporated at their lowest effective concentrations. The reason for this is that these dopants form deep electron traps and are capable of decreasing grain sensitivity if employed in relatively high concentrations. These LIRF and LIK dopants are preferably incorporated in concentrations of at least $1\times10^{-9}$ mole per silver up to $1\times10^{-6}$ mole per silver mole. However, higher levels of incorporation can be tolerated, up about $1\times10^{-4}$ mole per silver, when reductions from the highest attainable levels of sensitivity can be tolerated. Specific illustrations of useful Ir dopants contemplated for LIRF reduction and LIK improvement are provided by B. H. Carroll, "Iridium Sensitization: A Literature Review", *Photographic Science and Engineering*, Vol. 24, No. 6 November/December 1980, pp. 265–267; Iwaosa et al U.S. Pat. No. 3,901,711; Grzeskowiak et al U.S. Pat. No. 4,828,962; Kim U.S. Pat. No. 4,997,751; Maekawa et al U.S. Pat. No. 5,134,060; Kawai et al U.S. Pat. No. 5,164,292; and Asami U.S. Pat. Nos. 5,166,044 and 5,204,234.

The contrast of photographic elements containing silver iodochloride emulsions of the invention can be further increased by doping the silver iodochloride grains with a hexacoordination complex containing a nitrosyl or thionitrosyl ligand. Preferred coordination complexes of this type are represented by the formula:

$$[TE_4(NZ)E']^r \quad \text{(III)}$$

where

T is a transition metal;

E is a bridging ligand;

E' is E or NZ;

r is zero, −1, −2 or −3; and

Z is oxygen or sulfur.

The E ligands can take any of the forms found in the SET, LIRF and LIK dopants discussed above. A listing of suitable coordination complexes satisfying formula III is found in McDugle et al U.S. Pat. No. 4,933,272, the disclosure of which is here incorporated by reference.

The contrast increasing dopants (hereinafter also referred to as NZ dopants) can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, LIRF, LIK and NZ dopants have been set out above, it is recognized that specific optimum concentration ranges within these general ranges can be identified for specific applications by routine testing. It is specifically contemplated to employ the SET, LIRF, LIK and NZ dopants singly or in combination. For example, grains containing a combination of an SET dopant and Ir in a form that is not a SET are specifically contemplated. Similarly SET and NZ dopants can be employed in combination. Also NZ and Ir dopants that are not SET dopants can be employed in combination. In a specifically preferred form the invention an Ir dopant that is not an SET is employed in combination with a SET dopant and an NZ dopant. For this latter three-way combination of dopants it is generally most convenient in terms of precipitation to incorporate the NZ dopant first, followed by the SET dopant, with the Ir non-SET dopant incorporated last.

After precipitation and before chemical sensitization the emulsions can be washed by any convenient conventional technique. Conventional washing techniques are disclosed by *Research Disclosure*, Item 36544, cited above, Section III. Emulsion washing.

The emulsions can prepared in any mean grain size known to be useful in photographic print elements. Mean grain sizes in the range of from 0.15 to 2.5 mm are typical, with mean grain sizes in the range of from 0.2 to 2.0 mm being generally preferred.

The silver iodochloride emulsions can be chemically sensitized with active gelatin as illustrated by T. H. James, *The Theory of the Photographic Process*, 4th Ed., Macmillan, 1977, pp. 67–76, or with middle chalcogen (sulfur, selenium or tellurium), gold, a platinum metal (platinum, palladium, rhodium, ruthenium, iridium and osmium), rhenium or phosphorus sensitizers or combinations of these sensitizers, such as at pAg levels of from 5 to 10, pH levels of from 5 to 8 and temperatures of from 30 to 80° C., as illustrated by *Research Disclosure*, Vol. 120, April, 1974, Item 12008, *Research Disclosure*, Vol. 134, June, 1975, Item 13452, Sheppard et al U.S. Pat. No. 1,623,499, Matthies et al U.S. Pat. No. 1,673,522, Waller et al U.S. Pat. No. 2,399,083, Smith et al U.S. Pat. No. 2,448,060, Damschroder et al U.S. Pat. No. 2,642,361, McVeigh U.S. Pat. No. 3,297,447, Dunn U.S. Pat. No. 3,297,446, McBride U.K. Patent 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No.

3,565,633, Oftedahl U.S. Pat. Nos. 3,901,714 and 3,904,415 and Simons U.K. Patent 1,396,696, chemical sensitization being optionally conducted in the presence of thiocyanate derivatives as described in Damschroder U.S. Pat. No. 2,642,361, thioether compounds as disclosed in Lowe et al U.S. Pat. No. 2,521,926, Williams et al U.S. Pat. No. 3,021,215 and Bigelow U.S. Pat. No. 4,054,457, and azaindenes, azapyridazines and azapyrimidines as described in Dostes U.S. Pat. No. 3,411,914, Kuwabara et al U.S. Pat. No. 3,554,757, Oguchi et al U.S. Pat. No. 3,565,631 and Oftedahl U.S. Pat. No. 3,901,714, Kajiwara et al U.S. Pat. No. 4,897,342, Yamada et al U.S. Pat. No. 4,968,595, Yamada U.S. Pat. No. 5,114,838, Yamada et al U.S. Pat. No. 5,118,600, Jones et al U.S. Pat. No. 5,176,991, Toya et al U.S. Pat. No. 5,190,855 and EPO 0 554 856, elemental sulfur as described by Miyoshi et al EPO 0 294,149 and Tanaka et al EPO 0 297,804, and thiosulfonates as described by Nishikawa et al EPO 0 293,917. Additionally or alternatively, the emulsions can be reduction-sensitized, e.g., by low pAg (e.g., less than 5), high pH (e.g., greater than 8) treatment, or through the use of reducing agents such as stannous chloride, thiourea dioxide, polyamines and amineboranes as illustrated by Allen et al U.S. Pat. No. 2,983,609, Oftedahl et al *Research Disclosure*, Vol. 136, August, 1975, Item 13654, Lowe et al U.S. Pat. Nos. 2,518,698 and 2,739,060, Roberts et al U.S. Pat. Nos. 2,743,182 and '183, Chambers et al U.S. Pat. No. 3,026,203 and Bigelow et al U.S. Pat. No. 3,361,564. Yamashita et al U.S. Pat. No. 5,254,456, EPO 0 407 576 and EPO 0 552 650.

Further illustrative of sulfur sensitization are Mifune et al U.S. Pat. No. 4,276,374, Yamashita et al U.S. Pat. No. 4,746,603, Herz et al U.S. Pat. Nos. 4,749,646 and 4,810,626 and the lower alkyl homologues of these thioureas, Ogawa U.S. Pat. No. 4,786,588, Ono et al U.S. Pat. No. 4,847,187, Okumura et al U.S. Pat. No. 4,863,844, Shibahara U.S. Pat. No. 4,923,793, Chino et al U.S. Pat. No. 4,962,016, Kashi U.S. Pat. No. 5,002,866, Yagi et al U.S. Pat. No. 5,004,680, Kajiwara et al U.S. Pat. No. 5,116,723, Lushington et al U.S. Pat. No. 5,168,035, Takiguchi et al U.S. Pat. No. 5,198,331, Patzold et al U.S. Pat. No. 5,229,264, Mifune et al U.S. Pat. No. 5,244,782, East German DD 281 264 A5, German DE 4,118,542 Al, EPO 0 302 251, EPO 0 363 527, EPO 0 371 338, EPO 0 447 105 and EPO 0 495 253. Further illustrative of iridium sensitization are Ihama et al U.S. Pat. No. 4,693,965, Yamashita et al U.S. Pat. No. 4,746,603, Kajiwara et al U.S. Pat. No. 4,897,342, Leubner et al U.S. Pat. No. 4,902,611, Kim U.S. Pat. No. 4,997,751, Johnson et al U.S. Pat. No. 5,164,292, Sasaki et al U.S. Pat. No. 5,238,807 and EPO 0 513 748 Al. Further illustrative of tellurium sensitization are Sasaki et al U.S. Pat. No. 4,923,794, Mifune et al U.S. Pat. No. 5,004,679, Kojima et al U.S. Pat. No. 5,215,880, EPO 0 541 104 and EPO 0 567 151. Further illustrative of selenium sensitization are Kojima et al U.S. Pat. No. 5,028,522, Brugger et al U.S. Pat. No. 5,141,845, Sasaki et al U.S. Pat. No. 5,158,892, Yagihara et al U.S. Pat. No. 5,236,821, Lewis U.S. Pat. No. 5,240,827, EPO 0 428 041, EPO 0 443 453, EPO 0 454 149, EPO 0 458 278, EPO 0 506 009, EPO 0 512 496 and EPO 0 563 708. Further illustrative of rhodium sensitization are Grzeskowiak U.S. Pat. No. 4,847,191 and EPO 0 514 675. Further illustrative of palladium sensitization are Ihama U.S. Pat. No. 5,112,733, Sziics et al U.S. Pat. No. 5,169,751, East German DD 298 321 and EPO 0 368 304. Further illustrative of gold sensitizers are Mucke et al U.S. Pat. No. 4,906,558, Miyoshi et al U.S. Pat. No. 4,914,016, Mifune U.S. Pat. No. 4,914,017, Aida et al U.S. Pat. No. 4,962,015, Hasebe U.S. Pat. No. 5,001,042, Tanji et al U.S. Pat. No. 5,024,932, Deaton U.S. Pat. Nos. 5,049,484 and 5,049,485, Ikenoue et al U.S. Pat. No. 5,096,804, EPO 0 439 069, EPO 0 446 899, EPO 0 454 069 and EPO 0 564 910. The use of chelating agents during finishing is illustrated by Klaus et al U.S. Pat. No. 5,219,721, Mifune et al U.S. Pat. No. 5,221,604, EPO 0 521 612 and EPO 0 541 104. Sensitization is preferably carried out in the absence of bromides, as the iodochloride grains of the invention do not require bromide to achieve enhanced sensitivity.

Chemical sensitization can take place in the presence of spectral sensitizing dyes as described by Philippaerts et al U.S. Pat. No. 3,628,960, Kofron et al U.S. Pat. No. 4,439,520, Dickerson U.S. Pat. No. 4,520,098, Maskasky U.S. Pat. No. 4,693,965, Ogawa U.S. Pat. No. 4,791,053 and Daubendiek et al U.S. Pat. No. 4,639,411, Metoki et al U.S. Pat. No. 4,925,783, Reuss et al U.S. Pat. No. 5,077,183, Morimoto et al U.S. Pat. No. 5,130,212, Fickie et al U.S. Pat. No. 5,141,846, Kajiwara et al U.S. Pat. No. 5,192,652, Asami U.S. Pat. No. 5,230,995, Hashi U.S. Pat. No. 5,238,806, East German DD 298 696, EPO 0 354 798, EPO 0 509 519, EPO 0 533 033, EPO 0 556 413 and EPO 0 562 476. Chemical sensitization can be directed to specific sites or crystallographic faces on the silver halide grain as described by Haugh et al U.K. Patent 2,038,792, Maskasky U.S. Pat. No. 4,439,520 and Mifune et al EPO 0 302 528. The sensitivity centers resulting from chemical sensitization can be partially or totally occluded by the precipitation of additional layers of silver halide using such means as twin-jet additions or pAg cycling with alternate additions of silver and halide salts as described by Morgan U.S. Pat. No. 3,917,485, Becker U.S. Pat. No. 3,966,476 and *Research Disclosure*, Vol. 181, May, 1979, Item 18155. Also as described by Morgan cited above, the chemical sensitizers can be added prior to or concurrently with the additional silver halide formation.

During finishing urea compounds can be added, as illustrated by Burgmaier et al U.S. Pat. No. 4,810,626 and Adin U.S. Pat. No. 5,210,002. The use of N-methyl formamide in finishing is illustrated in Reber EPO 0 423 982. The use of ascorbic acid and a nitrogen containing heterocycle are illustrated in Nishikawa EPO 0 378 841. The use of hydrogen peroxide in finishing is disclosed in Mifune et al U.S. Pat. No. 4,681,838.

Sensitization can be effected by controlling gelatin to silver ratio as in Vandenabeele EPO 0 528 476 or by heating prior to sensitizing as in Berndt East German DD 298 319.

The emulsions can be spectrally sensitized in any convenient conventional manner. Spectral sensitization and the selection of spectral sensitizing dyes is disclosed, for example, in *Research Disclosure*, Item 36544, cited above, Section V. Spectral sensitization and desensitization.

The emulsions used in the invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines.

The cyanine spectral sensitizing dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphtotellurazolium, thiazolinium, dihydronaphthothiazolium, pyrylium and imidazopyrazinium quaternary salts.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3, 5-dione, pentan-2,4-dione, alkylsulfonyl acetonitrile, benzoylacetonitrile, malononitrile, malonamide, isoquinolin-4-one, chroman-2,4-dione, 5H-furan-2-one, 5H-3-pyrrolin-2-one, 1,1,3-tricyanopropene and telluracyclohexanedione.

One or more spectral sensitizing dyes may be employed. Dyes with sensitizing maxima at wavelengths throughout the visible and infrared spectrum and with a great variety of spectral sensitivity curve shapes are known. The choice and relative proportions of dyes depends upon the region of the spectrum to which sensitivity is desired and upon the shape of the spectral sensitivity curve desired. An example of a material which is sensitive in the infrared spectrum is shown in Simpson et al., U.S. Pat. No. 4,619,892, which describes a material which produces cyan, magenta and yellow dyes as a function of exposure in three regions of the infrared spectrum (sometimes referred to as "false" sensitization). Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

Spectral sensitizing dyes can also affect the emulsions in other ways. For example, spectrally sensitizing dyes can increase photographic speed within the spectral region of inherent sensitivity. Spectral sensitizing dyes can also function as antifoggants or stabilizers, development accelerators or inhibitors, reducing or nucleating agents, and halogen acceptors or electron acceptors, as disclosed in Brooker et al U.S. Pat. No. 2,131,038, Illingsworth et al U.S. Pat. No. 3,501,310, Webster et al U.S. Pat. No. 3,630,749, Spence et al U.S. Pat. No. 3,718,470 and Shiba et al U.S. Pat. No. 3,930,860.

Among useful spectral sensitizing dyes for sensitizing the emulsions described herein are those found in U.K. Patent 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,493,747, '748, 2,526,632, 2,739,964 (Reissue 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349, the disclosures of which are here incorporated by reference. Examples of useful supersensitizing-dye combinations, of non-light-absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898, the disclosures of which are here incorporated by reference.

Spectral sensitizing dyes can be added at any stage during the emulsion preparation. They may be added at the beginning of or during precipitation as described by Wall, *Photographic Emulsions*, American Photographic Publishing Co., Boston, 1929, p. 65, Hill U.S. Pat. No. 2,735,766, Philippaerts et al U.S. Pat. No. 3,628,960, Locker U.S. Pat. No. 4,183,756, Locker et al U.S. Pat. No. 4,225,666 and *Research Disclosure*, Vol. 181, May, 1979, Item 18155, and Tani et al published European Patent Application EP 301, 508. They can be added prior to or during chemical sensitization as described by Kofron et al U.S. Pat. No. 4,439, 520, Dickerson U.S. Pat. No. 4,520,098, Maskasky U.S. Pat. No. 4,435,501 and Philippaerts et al cited above. They can be added before or during emulsion washing as described by Asami et al published European Patent Application EP 287,100 and Metoki et al published European Patent Application EP 291,399. The dyes can be mixed in directly before coating as described by Collins et al U.S. Pat. No. 2,912,343. Small amounts of iodide can be adsorbed to the emulsion grains to promote aggregation and adsorption of the spectral sensitizing dyes as described by Dickerson cited above. Postprocessing dye stain can be reduced by the proximity to the dyed emulsion layer of fine high-iodide grains as described by Dickerson. Depending on their solubility, the spectral-sensitizing dyes can be added to the emulsion as solutions in water or such solvents as methanol, ethanol, acetone or pyridine; dissolved in surfactant solutions as described by Sakai et al U.S. Pat. No. 3,822,135; or as dispersions as described by Owens et al U.S. Pat. No. 3,469,987 and Japanese published Patent Application (Kokai) 24185/71. The dyes can be selectively adsorbed to particular crystallographic faces of the emulsion grain as a means of restricting chemical sensitization centers to other faces, as described by Mifune et al published European Patent Application 302,528. The spectral sensitizing dyes may be used in conjunction with poorly adsorbed luminescent dyes, as described by Miyasaka et al published European Patent Applications 270,079, 270,082 and 278,510.

The following illustrate specific spectral sensitizing dye selections:

SS-1

Anhydro-5'-chloro-3,3'-bis(3-sulfopropyl)naphtho[1,2-d] thiazolothiacyanine hydroxide, triethylammonium salt

SS-2

Anhydro-5'-chloro-3,3'-bis(3-sulfopropyl)naphtho[1,2-d] oxazolothiacyanine hydroxide, sodium salt

SS-3

Anhydro-4,5-benzo-3'-methyl-4'-phenyl-1-(3-sulfopropyl)-naphtho[1,2-d]thiazolothiazolocyanine hydroxide

SS-4

1,1'-Diethylnaphtho[1,2-d]thiazolo-2'-cyanine bromide

SS-5

Anhydro-1,1'-dimethyl-5,5'-bis(trifluoromethyl)-3-(4-sulfobutyl)-3'-(2,2,2-trifluoroethyl) benzimidazolocarbocyanine hydroxide

SS-6

Anhydro-3,3'-bis(2-methoxyethyl)-5,5'-diphenyl-9-ethyloxacarbocyanine, sodium salt

SS-7

Anhydro-1,1'-bis(3-sulfopropyl)-11-ethylnaphtho[1,2-d]oxazolocarbocyanine hydroxide, sodium salt

SS-8

Anhydro-5,5'-dichloro-9-ethyl-3,3'-bis(3-sulfopropyl)oxaselenacarbocyanine hydroxide, sodium salt

SS-9

5,6-Dichloro-3',3'-dimethyl-1,1',3-triethylbenzimidazolo3H-indolocarbocyanine bromide

SS-10

Anhydro-5,6-dichloro-1,1-diethyl-3-(3-sulfopropylbenzimidazolooxacarbocyanine hydroxide

SS-11

Anhydro-5,5'-dichloro-9-ethyl-3,3'-bis(2-sulfoethylcarbamoylmethyl)thiacarbocyanine hydroxide, sodium salt

SS-12

Anhydro-5',6'-dimethoxy-9-ethyl-5-phenyl-3-(3-sulfobutyl)-3'-(3-sulfopropyl)oxathiacarbocyanine hydroxide, sodium salt

SS-13

Anhydro-5,5'-dichloro-9-ethyl-3-(3-phosphonopropyl)-3'-(3-sulfopropyl)thiacarbocyanine hydroxide

SS-14

Anhydro-3,3'-bis(2-carboxyethyl)-5,5'-dichloro-9-ethylthiacarbocyanine bromide

SS-15

Anhydro-5,5'-dichloro-3-(2-carboxyethyl)-3'-(3-sulfopropyl)thiacyanine sodium salt

SS-16

9-(5-Barbituric acid)-3,5-dimethyl-3'-ethyltellurathiacarbocyanine bromide

SS-17

Anhydro-5,6-methylenedioxy-9-ethyl-3-methyl-31'-(3-sulfopropyl)tellurathiacarbocyanine hydroxide

SS-18

3-Ethyl-6,6'-dimethyl-3,1'-pentyl-9,11-neopentylenethiadicarbocyanine bromide

SS-19

Anhydro-3-ethyl-9,11-neopentylene-3'-(3-sulfopropyl)thiadicarbocyanine hydroxide

SS-20

Anhydro-3-ethyl-11,13-neopentylene-3'-(3-sulfopropyl)oxathiatricarbocyanine hydroxide, sodium salt

SS-21

Anhydro-5-chloro-9-ethyl-5'-phenyl-3'-(3-sulfobutyl)-3-(3-sulfopropyl)oxacarbocyanine hydroxide, sodium salt

SS-22

Anhydro-5,5'-diphenyl-3,3'-bis(3-sulfobutyl)-9-ethyloxacarbocyanine hydroxide, sodium salt

SS-23

Anhydro-5,5'-dichloro-3,3'-bis(3-sulfopropyl)-9-ethylthiacarbocyanine hydroxide, triethylammonium salt

SS-24

Anhydro-5,5'-dimethyl-3,3'-bis(3-sulfopropyl)-9-ethylthiacarbocyanine hydroxide, sodium salt

SS-25

Anhydro-5,6-dichloro-1-ethyl-3-(3-sulfobutyl)-1'-(3-sulfopropyl)benzimidazolonaphtho[1,2-d]thiazolocarbocyanine hydroxide, triethylammonium salt

SS-26

Anhydro-1,1'-bis(3-sulfopropyl)-11-ethylnaphth[1,2-d]oxazolocarbocyanine hydroxide, sodium salt

SS-27

Anhydro-3,9-diethyl-3'-methylsulfonylcarbamoylmethyl-5-phenyloxathiacarbocyanine p-toluenesulfonate

SS-28

Anhydro-6,6'-dichloro-1,1'-diethyl-3,3'-bis(3-sulfopropyl)-5,5'-bis(trifluoromethyl)benzimidazolocarbocyanine hydroxide, sodium salt

SS-29

Anhydro-5'-chloro-5-phenyl-3,3'-bis(3-sulfopropyl)oxathiacyanine hydroxide, triethylammonium salt

SS-30

Anhydro-5,5'-dichloro-3,3'-bis(3-sulfopropyl)thiacyanine hydroxide, sodium salt

SS-31

3-Ethyl-5-[1,4-dihydro-1-(4-sulfobutyl)pyridin-4-ylidene]rhodanine, triethylammonium salt

SS-32

1-Carboxyethyl-5-[2-(3-ethylbenzoxazolin-2-ylidene)ethylidene]-3-phenylthiohydantoin

SS-33

4-[2-(1,4-Dihydro-1-dodecylpyridinylidene)ethylidene]-3-phenyl-2-isoxazolin-5-one

SS-34

5-(3-Ethylbenzoxazolin-2-ylidene)-3-phenylrhodanine

SS-35

1,3-Diethyl-5-{[1-ethyl-3-(3-sulfopropyl)benzimidazolin-2-ylidene]ethylidene}-2-thiobarbituric acid

SS-36

5-[2-(3-Ethylbenzoxazolin-2-ylidene)ethylidene]-1-methyl-2-dimethylamino-4-oxo-3-phenylimidazolinium p-toluenesulfonate

SS-37

5-[2-(5-Carboxy-3-methylbenzoxazolin-2-ylidene)ethylidene]-3-cyano-4-phenyl-1-(4-methylsulfonamido-3-pyrrolin-5-one

SS-38

2-[4-(Hexylsulfonamido)benzoylcyanomethine]-2-(2-{3-(2-methoxyethyl)-5-[(2-methoxyethyl)sulfonamido)-benzoxazolin-2-ylidene}ethylidene)acetonitrile

SS-39

3-Methyl-4-[2-(3-ethyl-5,6-dimethylbenzotellurazolin-2-ylidene)ethylidene]-1-phenyl-2-pyrazolin-5-one

SS-40

3-Heptyl-1-phenyl-5-{4-[3-(3-sulfobutyl)-naphtho[1,2-d]thiazolin]-2-butenylidene}-2-thiohydantoin

SS-41

1,4-Phenylene-bis(2-aminovinyl-3-methyl-2-thiazolinium) dichloride

SS-42

Anhydro-4-{2-[3-(3-sulfopropyl)thiazolin-2-ylidene]ethylidene}-2-{3-[3-(3-sulfopropyl)thiazolin-2-ylidene]propenyl-5-oxazolium, hydroxide, sodium salt

SS-43

3-Carboxymethyl-5-(3-carboxymethyl-4-oxo-5-methyl-1,3,4-thiadiazolin-2-ylidene)ethylidene]thiazolin-2-ylidene}rhodanine, dipotassium salt

SS-44

1,3-Diethyl-5-[1-methyl-2-(3,5-dimethylbenzotellurazolin-2-ylidene)ethylidene]-2-thiobarbituric acid

SS-45

3-Methyl-4-[2-(3-ethyl-5,6-dimethylbenzotellurazolin-2-ylidene)-1-methylethylidene]-1-phenyl-2-pyrazolin-5-one

SS-46

1,3-Diethyl-5-[1-ethyl-2-(3-ethyl-5,6-dimethoxybenzotellurazolin-2-ylidene)ethylidene]-2-thiobarbituric acid

SS-47

3-Ethyl-5-{[(ethylbenzothiazolin-2-ylidene)-methyl][(1,5-dimethylnaphtho[1,2-d]selenazolin-2-ylidene)methyl]-methylene}rhodanine

SS-48

5-{Bis[(3-ethyl-5,6-dimethylbenzothiazolin-2-ylidene)-methyl]methylene}-1,3-diethylbarbituric acid

SS-49

3-Ethyl-5-{[(3-ethyl-5-methylbenzotellurazolin-2-ylidene)methyl][1-ethylnaphtho[1,2-d]-tellurazolin-2-ylidene)methyl]methylene}rhodanine

SS-50

Anhydro-5,5'-diphenyl-3,3'-bis(3-sulfopropyl)thiacyanine hydroxide, triethylammonium salt

SS-51

Anhydro-5-chloro-5'-phenyl-3,3'-bis(3-sulfopropyl) thiacyanine hydroxide, triethylammonium salt

SS-52

Anhydro-5-chloro-5'-pyrrolo-3,3'-bis(3-sulfopropyl)-thiacyanine hydroxide, triethylammonium salt Preferred supersensitizing compounds for use with the spectral sensitizing dyes are 4,4'-bis(1,3,5-triazinylamino) stilbene-2,2'-bis(sulfonates).

A single silver iodochloride emulsion satisfying the requirements of the invention can be coated on photographic support to form a photographic element. Any convenient conventional photographic support can be employed. Such supports are illustrated by *Research Disclosure*, Item 36544, previously cited, Section XV. Supports. In a specific, preferred form of the invention the silver iodochloride emulsions are employed in photographic elements intended to form viewable images—i.e., print materials. Materials of the invention may be used in combination with a photographic element coated on pH adjusted support, or support with reduced oxygen permeability. In such elements the supports are reflective (e.g., white). Reflective (typically paper) supports can be employed. Typical paper supports are partially acetylated or coated with baryta and/or a polyolefin, particularly a polymer of an a-olefin containing 2 to 10 carbon atoms, such as polyethylene, polypropylene, copolymers of ethylene and propylene and the like. Polyolefins such as polyethylene, polypropylene and polyallomers—e.g., copolymers of ethylene with propylene, as illustrated by Hagemeyer et al U.S. Pat. No. 3,478,128, are preferably employed as resin coatings over paper as illustrated by Crawford et al U.S. Pat. No. 3,411,908 and Joseph et al U.S. Pat. No. 3,630,740, over polystyrene and polyester film supports as illustrated by Crawford et al U.S. Pat. No. 3,630,742, or can be employed as unitary flexible reflection supports as illustrated by Venor et al U.S. Pat. No. 3,973,963. More recent publications relating to resin coated photographic paper are illustrated by Kamiya et al U.S. Pat. No. 5,178,936, Ashida U.S. Pat. No. 5,100,770, Harada et al U.S. Pat. No. 5,084,344, Noda et al U.S. Pat. No. 5,075,206, Bowman et al U.S. Pat. No. 5,075,164, Dethlefs et al U.S. Pat. Nos. 4,898,773, 5,004,644 and 5,049,595, EPO 0 507 068 and EPO 0 290 852, Saverin et al U.S. Pat. No. 5,045,394 and German OLS 4,101,475, Uno et al U.S. Pat. No. 4,994,357, Shigetani et al U.S. Pat. Nos. 4,895,688 and 4,968,554, Tamagawa U.S. Pat. No. 4,927,495, Wysk et al U.S. Pat. No. 4,895,757, Kojima et al U.S. Pat. No. 5,104,722, Katsura et al U.S. Pat. No. 5,082,724, Nittel et al U.S. Pat. No. 4,906,560, Miyoshi et al EPO 0 507 489, Inahata et al EPO 0 413 332, Kadowaki et al EPO 0 546 713 and EPO 0 546 711, Skochdopole WO 93/04400, Edwards et al WO 92/17538, Reed et al WO 92/00418 and Tsubaki et al German OLS 4,220,737. Kiyohara et al U.S. Pat. No. 5,061,612, Shiba et al EPO 0 337 490 and EPO 0 389 266 and Noda et al German OLS 4,120,402 disclose pigments primarily for use in reflective supports. Reflective supports can include optical brighteners and fluorescent materials, as illustrated by Martic et al U.S. Pat. No. 5,198,330, Kubbota et al U.S. Pat. No. 5,106,989, Carroll et al U.S. Pat. No. 5,061,610 and Kadowaki et al EPO 0 484 871.

It is, of course, recognized that the photographic elements of the invention can include more than one emulsion. Where more than one emulsion is employed, such as in a photographic element containing a blended emulsion layer or separate emulsion layer units, all of the emulsions can be silver iodochloride emulsions as contemplated by this invention. Alternatively one more conventional emulsions can be employed in combination with the silver iodochloride emulsions of this invention. For example, a separate emulsion, such as a silver chloride or bromochloride emulsion, can be blended with a silver iodochloride emulsion according to the invention to satisfy specific imaging requirements. For example emulsions of differing speed are conventionally blended to attain specific aim photographic characteristics. Instead of blending emulsions, the same effect can usually be obtained by coating the emulsions that might be blended in separate layers. It is well known in the art that increased photographic speed can be realized when faster and slower emulsions are coated in separate layers with the faster emulsion layer positioned to receiving exposing radiation first. When the slower emulsion layer is coated to receive exposing radiation first, the result is a higher contrast image. Specific illustrations are provided by *Research Disclosure*, Item 36544, cited above Section I. Emulsion grains and their preparation, Subsection E. Blends, layers and performance categories.

The emulsion layers as well as optional additional layers, such as overcoats and interlayers, contain processing solution permeable vehicles and vehicle modifying addenda. Typically these layer or layers contain a hydrophilic colloid, such as gelatin or a gelatin derivative, modified by the addition of a hardener. Illustrations of these types of materials are contained in *Research Disclosure*, Item 36544, previously cited, Section II. Vehicles, vehicle extenders, vehicle-like addenda and vehicle related addenda. The overcoat and other layers of the photographic element can usefully include an ultraviolet absorber, as illustrated by *Research Disclosure*, Item 36544, Section VI. UV dyes/optical brighteners/luminescent dyes, paragraph (1). The overcoat, when present can usefully contain matting to reduce surface adhesion. Surfactants are commonly added to the coated layers to facilitate coating. Plasticizers and lubricants are commonly added to facilitate the physical handling properties of the photographic elements. Antistatic agents are commonly added to reduce electrostatic discharge. Illustrations of surfactants, plasticizers, lubricants and matting agents are contained in *Research Disclosure*, Item 36544, previously cited, Section IX. Coating physical property modifying addenda.

Preferably, the photographic elements of the invention include a conventional processing solution decolorizable antihalation layer, either coated between the emulsion layer (s) and the support or on the back side of the support. Such layers are illustrated by *Research Disclosure*, Item 36544, cited above, Section VIII. Absorbing and Scattering Materials, Subsection B, Absorbing materials and Subsection C. Discharge.

A specific preferred application of the silver iodochloride emulsions of the invention is in color photographic elements, particularly color print (e.g., color paper) photographic elements intended to form multicolor images. In multicolor image forming photographic elements at least three superimposed emulsion layer units are coated on the support to separately record blue, green and red exposing radiation. The blue recording emulsion layer unit is typically constructed to provide a yellow dye image on processing, the green recording emulsion layer unit is typically constructed to provide a magenta dye image on processing, and the red recording emulsion layer unit is typically constructed to provide a cyan dye image on processing. Each emulsion layer unit can contain one, two, three or more separate emulsion layers sensitized to the same one of the blue, green and red regions of the spectrum. When more than one emulsion layer is present in the same emulsion layer unit, the emulsion layers typically differ in speed. Typically interlayers containing oxidized developing agent scavengers, such as ballasted hydroquinones or aminophenols, are interposed between the emulsion layer units to avoid color contamination. Ultraviolet absorbers are also commonly coated over the emulsion layer units or in the interlayers. Any convenient conventional sequence of emulsion layer units can be employed, with the following being the most typical:

| |
|---|
| Surface Overcoat |
| Ultraviolet Absorber |
| Red Recording Cyan Dye Image Forming |
| Emulsion Layer Unit |
| Scavenger Interlayer |
| Ultraviolet Absorber |
| Green Recording Magenta Dye Image Forming |
| Emulsion Layer Unit |
| Scavenger Interlayer |
| Blue Recording Yellow Dye Image Forming |
| Emulsion Layer Unit |
| Reflective Support |

Further illustrations of this and other layers and layer arrangements in multicolor photographic elements are provided in *Research Disclosure*, Item 36544, cited above, Section XI. Layers and layer arrangements.

Each emulsion layer unit of the multicolor photographic elements contain a dye image forming compound. The dye image can be formed by the selective destruction, formation or physical removal of dyes. Element constructions that form images by the physical removal of preformed dyes are illustrated by *Research Disclosure*, Vol. 308, December 1989, Item 308119, Section VII. Color materials, paragraph H. Element constructions that form images by the destruction of dyes or dye precursors are illustrated by *Research Disclosure*, Item 36544, previously cited, Section X. Dye image formers and modifiers, Subsection A. Silver dye bleach. Dye-forming couplers are illustrated by *Research Disclosure*, Item 36544, previously cited, Section X. Subsection B. Image-dye-forming couplers. It is also contemplated to incorporate in the emulsion layer units dye image modifiers, dye hue modifiers and image dye stabilizers, illustrated by *Research Disclosure*, Item 36544, previously cited, Section X. Subsection C. Image dye modifiers and Subsection D. Hue modifiers/stabilization. The dyes, dye precursors, the above-noted related addenda and solvents (e.g., coupler solvents) can be incorporated in the emulsion layers as dispersions, as illustrated by *Research Disclosure*, Item 36544, previously cited, Section X. Subsection E. Dispersing and dyes and dye precursors.

Various types of polymeric addenda could be advantageously used in conjunction with elements of the invention. Recent patents, particularly relating to color paper, have described the use of oil-soluble water-insoluble polymers in coupler dispersions to give improved image stability to light, heat and humidity, as well as other advantages, including abrasion resistance, and manufacturability of product.

The thiosulfonate of formula (I) $Z_1SO_2SM_1$, $Z_1$ may be alkyl, aryl, heteroaryl, arylalkyl or they may be substituted aryl wherein the substituent can be alkyl, alkoxy, halogen, etc. Additionally $Z_1$ may comprise of a polymeric backbone wherein the thiosulfonate group is repeated. $M_1$ may be any of the monovalent metal such as sodium or potassium or tetraalkylammonium cations.

Preparations of compounds of formula (I) have been described in the chemical literature such as in *Chem. Lett.* 1987, 11, 2161; *Organic Syntheses Collective* Volume VI, 1988, p 1016; *Organic Syntheses*, 1974, 54, 33; *J. Org. Chem.* 1986, 51(26), 5235; *Biochem. Prep.* 1963, 10, 72, or they may also be commercially available. Specific preferred examples of thiosulfonates are illustrated below:

IA

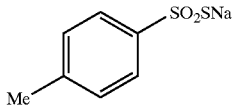

IB

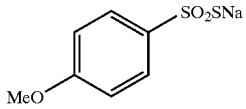

IC

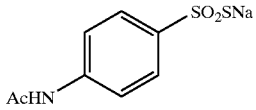

ID $EtSO_2SNa$

Useful ranges of thiosulfonates are from about 0.01 to about 5000 $\mu$mol per silver mol, and more preferably from about 0.1 to about 10,000 $\mu$mol per silver mol, and most preferably from about 1.0 to about 5,000 $\mu$mol per silver mol for best sensitivity and contrast.

The sulfinates of formula (II) $Z_2SO_2M_2$, $Z_2$ may be alkyl, aryl, heteroaryl, arylalkyl or they may be substituted aryl wherein the substituent can preferably be alkyl, alkoxy, or halogen. Other substituent groups may be alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen groups, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups,cyano groups, sulfo groups, and amino groups. Additionally $Z_2$ may comprise of a polymeric backbone wherein the sulfinate group is repeated. $M_2$ may be any of the monovalent metal such as sodium or potassium or tetraalkylammonium cations.

The sulfinates are also commercially available or they may be obtained by reduction of sulfonyl chlorides as taught in standard organic textbooks.

IIA

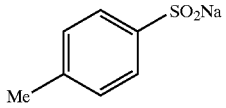

IIB

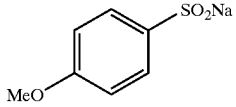

-continued

IIC

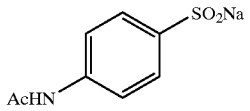

IID $EtSO_2Na$

Useful ranges of sulfinates are from about 0.001 to about 50,000 $\mu$mol per silver mol, and more preferably from about 0.01 to about 5,000 $\mu$mol, and most preferably from about 0.1 to about 500 $\mu$mol per silver mol for high sensitivity and good contrast density. The ratio of thiosulfonate to sulfinate may vary from 1:0.1 to 1:10. They could be premixed in solution or they may in added separately to the emulsion.

These compounds may be added to the silver halide emulsion during the emulsion precipitation process, in or after the sensitization process.

Couplers that form yellow dyes upon reaction with oxidized and color developing agent are represented by the following formulae:

YELLOW-1

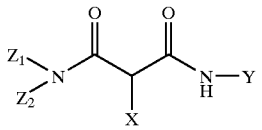

YELLOW-2

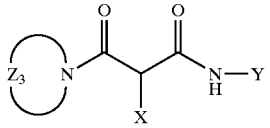

YELLOW-3

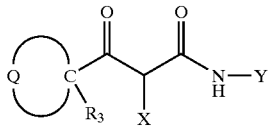

wherein $R_3$, $Z_1$ and $Z_2$ each represent a substituent; X is hydrogen or a coupling-off group; Y represents an aryl group or a heterocyclic group; $Z_3$ represents an organic residue required to form a nitrogen-containing heterocyclic group together with the >N—; and Q represents nonmetallic atoms necessary to form a 3- to 5-membered hydrocarbon ring or a 3- to 5-membered heterocyclic ring which contains at least one hetero atom selected from N, O, S, and P in the ring. Particularly preferred is when $Z_1$ and $Z_2$ each represents an alkyl group, an aryl group, or a heterocyclic group. Typical of yellow couplers suitable for the invention are:

Y-1
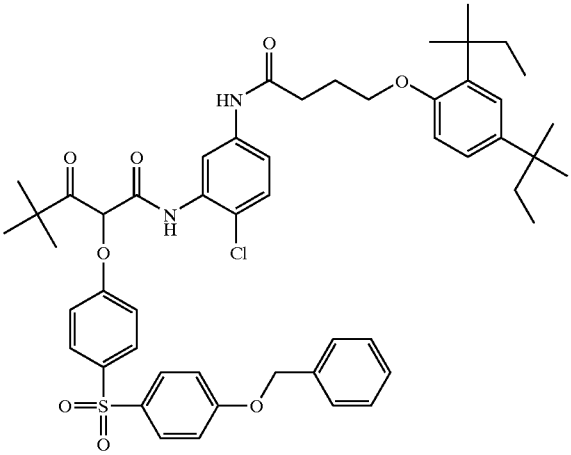
Y-2
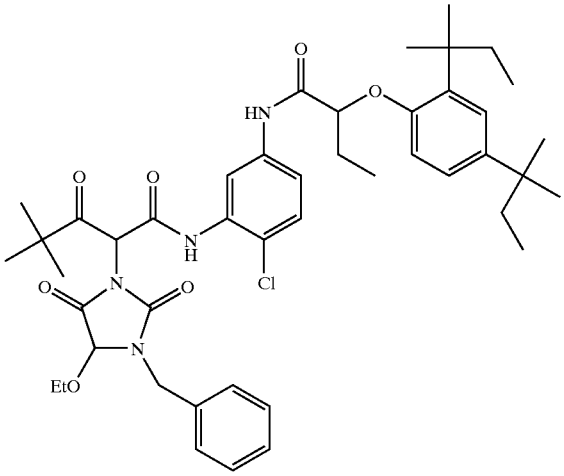
Y-3
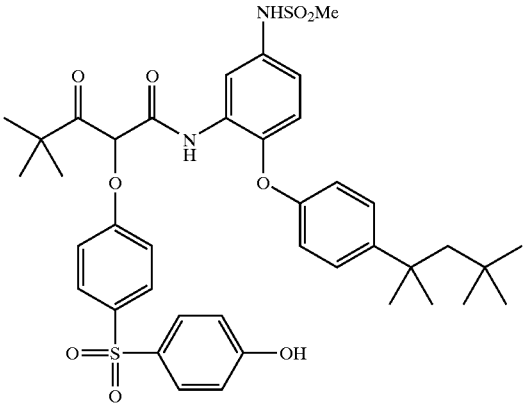
-continued
Y-4
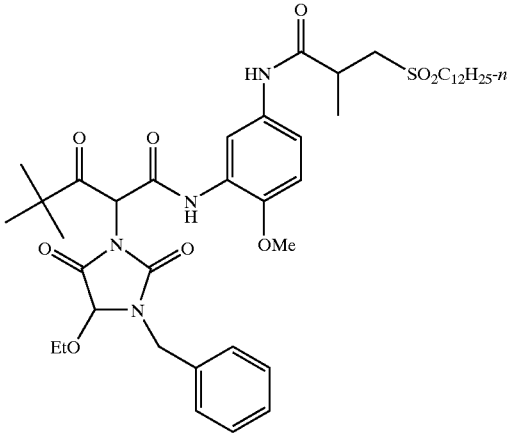
Y-5
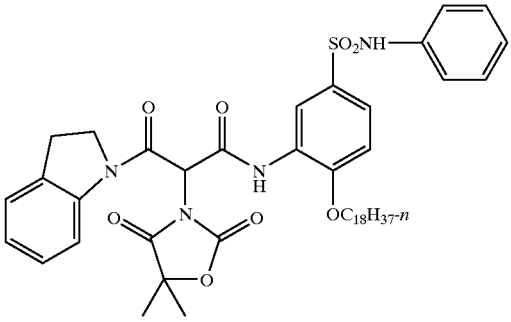
Y-6
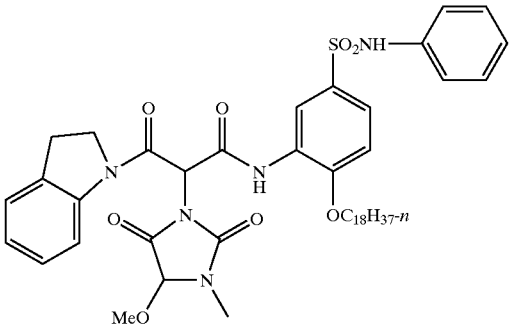
Y-7
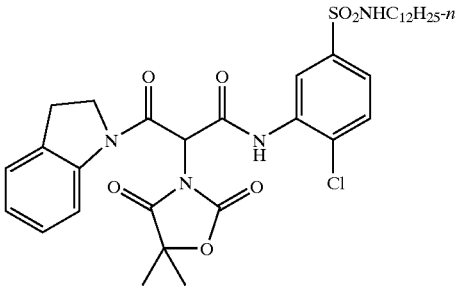

-continued

Y-8

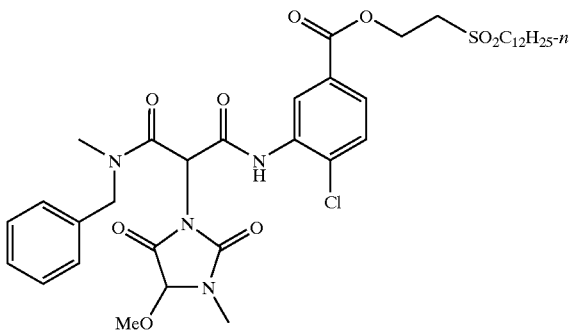

Y-9

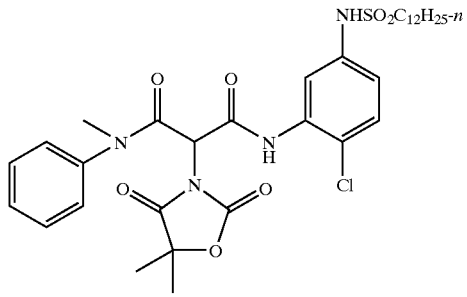

Y-10

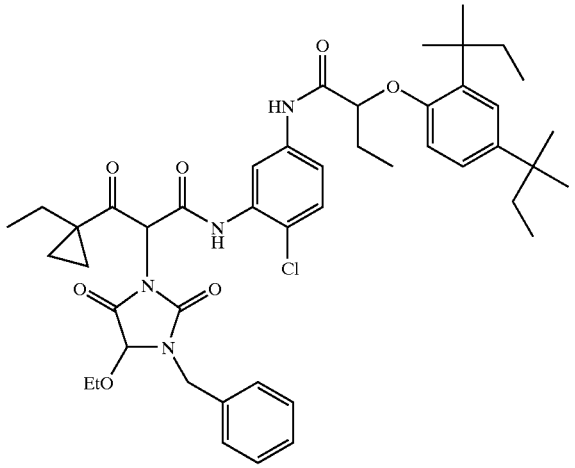

Even though the present invention is specifically contemplated for the blue sensitive layer, other couplers and sensitizing dyes may be used such that the magenta and cyan layers can be similarly benefited.

The following examples illustrate the practice of this invention. They are not intended to be exhaustive of all possible variations of the invention. Parts and percentages are by weight unless otherwise indicated.

EXAMPLE 1

Emulsion A (control), AgCl (100% AgCl), cubic morphology.

To a stirred tank reactor containing 6.9 kg of distilled water and 240 g of bone gelatin was added 218 g of a 4.11 M NaCl solution such that the mixture was maintained at pAg 7.15 at 68.3° C. 1,8-Dihydroxy-3,6-dithiaoctane (1.93 g) was added to the reactor 30 s before the introduction of the silver and salt streams. The silver stream (4 M $AgNO_3$ ) was introduced at 50.6 ml/min while the salt stream (3.8 M NaCl) at a rate such that the pAg was maintained at 7.15. After 5 min, the silver stream was accelerated to 87.1 ml/min in 6 min with the salt stream maintaining a constant pAg of 7.15. These rates remain unchanged for another 39.3 min at which time both streams were turned off simultaneously. This preparation yielded 16.5 moles of silver iodochloride crystals having an average cubic edge length of 0.78 $\mu$m.

Emulsion B, AgICl (0.3 mole % iodide), tetradecahedral morphology.

This emulsion was prepared similar to Emulsion A, except at the point after the accelerated flow (the silver stream had been introduced for 36 min at 87.1 ml/min and the salt stream maintaining a constant pAg of 7.15), 200 ml of a 0.25 M KI solution was dumped into the stirred reactor. The silver and the salt streams continued at the same rates after the KI dump for another 3.5 min when both streams were turned off simultaneouly. This preparation yielded 16.5 moles of silver iodochloride crystals with an average cubic edge length of 0.81 $\mu$m.

Emulsions C, D, and E, AgClI (0.3 M % iodide) tetradecahedral morphology. These emulsions were prepared similar to Emulsion B, except that 5, 10 and 40 $\mu$mol/Ag mol of compound IA in the presence of IIA at 0.10× amount of IA were added to the stirred tank reactor before the simultaneous pumping of the silver and the salt solutions.

Emulsions A through E were chemically sensitized with a colloidal dispersion of aurous sulfide at 4.6 mg/Ag mol at 40° C. The emulsions were heated to 60° C. when a blue spectral sensitizing dye, anhydro-5-chloro-3,3'-di(3-sulfopropyl) naphtho[1,2-d] thiazolothiacyanine hydroxide triethylammonium salt (220 mg) and 0.103 g of 1-(3-acetamidophenyl)-5-mercaptotetrazole per Ag mole were added. This blue sensitized silver iodochloride negative emulsion further contained a yellow dye-forming coupler alpha-(4-(4-benzyloxy-phenylsulfonyl)phenoxy)-alpha (pivalyl)-2-chloro-5-(gamma-(2,4-di-5-amylphenoxy) butyramido)acetanilide (1 g/$m^2$) in di-n-butylphthalate coupler solvent (0.27 g/$m^2$) and gelatin (1.77 g/$m^2$). The emulsion (0.279.g Ag/$m^2$) was coated on a resin coated paper support and 1.076 g/$m^2$ gel overcoat was applied as a protective layer along with the hardener bis (vinylsulfonyl) methyl ether in an amount of 1.8% of the total gelatin weight.

Daylight exposures for obtaining the dyed speeds were made with a tungsten lamp designed to simulate a color negative print exposure source. This lamp had a color temperature of 3000 K, log lux 2.95. The exposures were for 0.1 second through a combination of magenta and yellow filters, a 0.3 ND (Neutral Density), and a UV filter using a 0–3 step tablet (0.15 increments).

The processing consisted of a color development (45 s, 35° C.), bleach-fix (45 s, 35° C.) and stabilization or water wash (90 s, 35° C.) followed by drying (60 s, 60° C). The chemistry used in the Colenta processor consisted of the following solutions:

| Developer: | |
|---|---|
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonyl aminoethyl)-2-methyl-phenylenediaminesesquisulfate monohydrate | 5.0 g |
| Stilbene compound stain reducing agent | 2.3 g |

-continued

| | |
|---|---|
| Lithium sulfate | 2.7 g |
| Acetic acid | 9.0 mL |
| Water to total 1 liter, pH adjusted to 6.2 | |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Ethylenediaminetetracetic acid ferric ammonium salt | 40 g |
| Stabilizer | |
| Sodium citrate | 1 g |
| Water to total 1 liter, pH adjusted to 7.2 | |

The speed at 1.0 density unit was taken as a measure of the sensitivity of the emulsion.

The sensitivities of emulsions A through E are listed in Table I. These data show the speed enhancement

TABLE I

| | | Cpd IA* | DL | |
|---|---|---|---|---|
| Emul. | M % KI | (μmol/Ag m) | Speed | Dmin |
| A (comparison) | 0 | 0 | 94 | 0.05 |
| B (comparison) | 0.3 | 0 | 177 | 0.17 |
| C (invention) | 0.3 | 5 | 178 | 0.08 |
| D (invention) | 0.3 | 10 | 173 | 0.08 |
| E (invention) | 0.3 | 40 | 174 | 0.08 |

*IA is mixed with IIA at 10X amount of IIA.

of iodide containing emulsions with tetradecahedral morphology over the comparison emulsion with cubic morphology (Emulsion A). It is also clear that the undesirable fog (Dmin) of the comparison iodide containing emulsion (Emulsion B) without the compound of the present invention is significantly higher than those of the iodide emulsions with compound IA (emulsions C through E).

EXAMPLE 2

Emulsions F, G and H, AgClI (0.3 M % iodide), tetradecahedral morphology, prepared similar to Emulsion B, except that 10, 30 and 50 μmol/Ag mol respectively of compound IA were added after the precipitation but just before the chemical sensitization. These emulsions were similarly sensitized, coated, exposed and processed as those in Example 1.

Data in Table II show that compound IA is equally effective in controlling fog and still retains the speed advantage of the iodochloride emulsion when added in the chemical ripening process

TABLE II

| | | Cpd IA* | DL | |
|---|---|---|---|---|
| Emul. | M % KI | (μmol/Ag m) | Speed | Dmin |
| A (comparison) | 0 | 0 | 94 | 0.05 |
| B (comparison) | 0.3 | 0 | 177 | 0.17 |
| F (invention) | 0.3 | 10 | 180 | 0.08 |
| G (invention) | 0.3 | 30 | 182 | 0.08 |
| H (invention) | 0.3 | 50 | 185 | 0.09 |

*IA is mixed with IIA at 10X amount of IIA.

EXAMPLE 3

Emulsions I and J, AgClI (0.3 M % iodide), tetradecahedral morphology, prepared similar to Emulsion B, except that 10 and 50 μmol/Ag mol of a conventional antifoggant, compound III, were mixed in the silver stream during precipitation.

Emulsion K, AgClI (0.3 M % iodide), tetradecahedral morphology, prepared similar to Emulsion B, except that 0.0011 μmol/Ag mol of compound IV was mixed in the silver stream during precipitation.

Emulsion L AgClI (0.3 M % iodide), tetradecahedral morphology, prepared similar to Emulsion B, except that 6 μmol/Ag mol of a conventional antifoggant, compound V was added to the emulsion just prior to coating.

Emulsion M, AgClI (0.3 M % iodide), tetradecahedral morphology, prepared similar to Emulsion B, except that 0.0011 μmol/Ag mol of compound IV was mixed in the silver stream during precipitation, and 6 μmol/Ag mol of compound V was added to the emulsion just prior to coating.

(III)

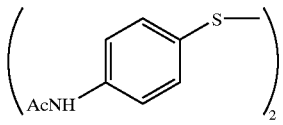

(IV)

$HgCl_2$ (V)

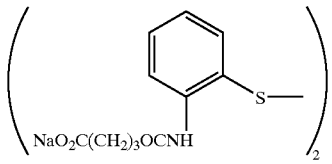

These emulsions were similarly sensitized, coated, exposed and processed as those in Example 1.

Data in Table IV show that the use of conventional antifoggants such as those shown above either are not as effective in suppressing fog as emulsions containing compound IA (Table I). Or, as in Emulsion J, a severe speed loss is observed. Emulsion D of the present invention shows good speed with strong antifogging activity.

TABLE IV

| | | | | DL | |
|---|---|---|---|---|---|
| Emul. | M % KI | Compound | (μmol/m) | Speed | Dmin |
| A (comparison) | 0 | none | 0 | 94 | 0.05 |
| B (comparison) | 0.3 | none | 0 | 177 | 0.17 |
| D (invention) | 0.3 | IA* | 10 | 176 | 0.08 |
| I (comparison) | 0.3 | III | 10 | 178 | 0.15 |
| J (comparison) | 0.3 | III | 50 | 87 | 0.08 |
| K (comparison) | 0.3 | IV | 0.0011 | 192 | 0.11 |
| L (comparison) | 0.3 | V | 6 | 186 | 0.17 |
| M (comparison) | 0.3 | IV + V | 0.0011 + 6 | 189 | 0.11 |

*IA is mixed with IIA at 10X amount of IIA.

EXAMPLE 4

An emulsion N, made accordance with the method described, having an effective cubic edge length of 0.78μ, and containing 0.3 M % iodide, was chemically sensitized as for emulsion A. In addition, a solution of piperidino hexose reductone was added at 940 mg/Ag mol, followed by a solution of potassium chloride at 20.45 mg/m$^2$. Then, to the yellow dye-forming coupler dispersion was added various amounts of IA and IIA. The emulsion was coated, exposed, and processed as in Example 1. Further, two sets of coatings were subjected to accelerated keeping conditions of one and two weeks at 37.8° C. while two other sets were stored at −17.8° C. also for one and two weeks.

Table V illustrates the advantage of the use of combination of thiosulfonates and sulfinates in the coupler dispersion even in the presence of other stabilizers commonly used in the photographic art. Under accelerated keeping conditions, coatings containing these compounds have less change in either speed or fog relative to the control which has no thiosulfonate compound added. Additionally, the sensitivity of the emulsion is hardly affected by the thiosulfonate sulfinate combination.

TABLE V

| IA* | | | 1 week | | 2 week | |
|---|---|---|---|---|---|---|
| mg | Fresh | | 37.8 vs. | −17.8° C. | 37.8 vs. | −17.8° C. |
| Ag mol | Speed | Fog | ΔSpeed | ΔFog | ΔSpeed | ΔFog |
| 0 | 199 | 0.09 | 7.9 | 0.06 | 11.4 | 0.15 |
| 300 | 199 | 0.09 | 3.7 | 0.04 | 5.6 | 0.08 |
| 600 | 199 | 0.09 | 3.0 | 0.04 | 5.8 | 0.10 |

*IA is mixed with IIA at a 1:1 ratio.

It is clear that the unique combination of "dump iodide" plus the "tetradecahedral" morphology gives us the excellent sensitivity improvement of the present AgCl emulsions over the conventional 3D chloride cubes. It is also seen that the combination of thiosulfonates and sulfinates of the present invention is very effective in reducing the undesirable fog produced during either the precipitation or sensitization.

The invention has been described in detail with particular reference to preferred embodiments thereof, but it will be understood that variations and modifications can be effected within the spirit and scope of the invention.

What is claimed is:

1. A radiation sensitive emulsion comprised of a dispersing medium and silver iodochloride grains wherein the silver iodochloride grains are cubical grains bounded by {100} crystal faces satisfying the orientation and spacing of cubic grains;

contain 0.3 mole percent iodide, based on total silver, with maximum iodide concentrations located nearer the surface of the grains than their center, comprise at least one {111} crystal face;

wherein said emulsion further comprises a thiosulfonate of Formula I and a sulfinate of Formula II wherein Formula I is:

$$Z_1S_{O2}SM_1 \quad \text{(I)}$$

wherein $Z_1$ is alkyl, aryl, heteroaryl, arylalkyl, or a polymeric backbone wherein the thiosulfonate group is repeated;

Mis a monovalent metal or a tetraalkylammonium cation;

Formula II is:

$$Z_2SO_2M_2 \quad \text{(II)}$$

Wherein $Z_2$ is alkyl, aryl, heteroaryl, arylalkyl, or a polymeric backbone wherein the sulfinate group is repeated;

$M_2$ is a monovalent metal or a tetraalkylammonium cation;

wherein iodide forming the grains is confined to exterior portions of the grains accounting for up to 15 percent of total silver; and wherein the ratio of said thiosulfonate to said sulfinate is between 1:0.1 and 1:10.

2. The radiation sensitive emulsion according to claim 1 wherein the grain size coefficient of variation of the silver iodochloride grains is less than 35 percent.

3. The radiation sensitive emulsion according to claim 1 wherein the silver iodochloride grains include tetradecahedral grains having {111} and {100} crystal faces.

4. The emulsion of claim 3 wherein said thiosulfonate consists of at least one of

IA

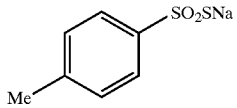

IB

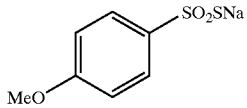

IC

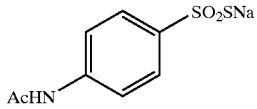

and

ID $EtSO_2SNa$.

5. The emulsion of claim 1 wherein said sulfinate consists of at least one of

IIA

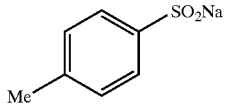

IIB

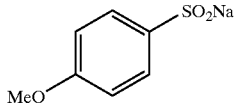

IIC

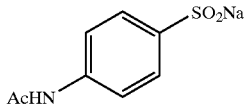

and

IID $EtSO_2Na$.

6. The emulsion of claim 1 wherein said thiosulfonate is present in an amount of between about 1.0 and about 5,000 μmol per silver mol, and said sulfinate is present in an amount of between about 0.1 and 50,000 μmol per silver mol.

7. The emulsion of claim 1 wherein said silver iodochloride grains comprise about 99% silver chloride.

8. A photographic element comprising at least one layer comprising a radiation sensitive emulsion comprised of a dispersing medium and silver iodochloride grains wherein the silver iodochloride grains are cubical grains bounded by {100} crystal faces satisfying the relative orientation and spacing of cubic grains;

contain 0.3 mole percent iodide, based on total silver, with maximum iodide concentrations located nearer the surface of the grains than their center, comprise at least one {111} crystal face and wherein said emulsion further comprises a thiosulfonate of Formula I and a sulfinate of Formula II wherein Formula I is $$Z_1SO_2SM_1 \quad (I)$$

wherein $Z_1$ is alkyl, aryl, heteroaryl, arylalkyl, or a polymeric backbone wherein the thiosulfonate group is repeated and

M1 is a monovalent metal or a tetraalkylammonium cation, and

Formula II is $$Z_2SO_2M_2 \quad (II)$$

wherein $Z_2$ is alkyl, aryl, heteroaryl, arylalkyl, substituted aryl or a polymeric backbone wherein the sulfinate group is repeated;

$M_2$ is a monovalent metal or a tetraalkylammonium cation;

wherein iodide forming the grains is confined to exterior portions of the grains accounting for up to 15 percent of total silver; and wherein the ratio of thiosulfonate to sulfinate is between 1:0.1 and 1:10.

9. The element according to claim 8 wherein the grain size coefficient of variation of the silver iodochloride grains is less than 35 percent.

10. The element according to claim 8 wherein the silver iodochloride grains include tetradecahedral grains having {111} and {100} crystal faces.

11. The photographic element of claim 8 wherein said sulfinate is selected from the group consisting of

IIA

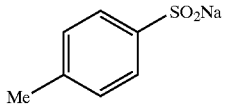

IIB

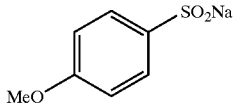

-continued

IIC

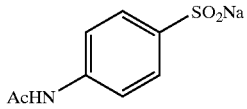

and

IID $EtSO_2Na$.

12. The emulsion of claim 8 wherein said thiosulfonate comprises at least one member selected from the group consisting of

IA

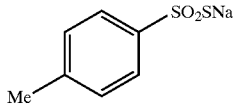

IB

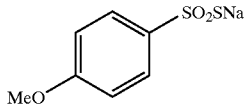

IC

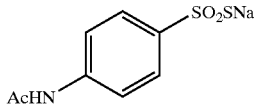

and

ID $EtSO_2SNa$.

13. The element of claim 8 wherein said at least one layer comprises a blue sensitive layer.

14. The element of claim 8 wherein said thiosulfonate is present in an amount of between about 1.0 and about 5,000 mmol per silver mol, and said sulfinate is present in an amount of between about 0.1 and 50,000 mmol per silver mol.

15. The element of claim 8 wherein said silver iodochloride grains comprise about 99% silver chloride.

* * * * *

UNITED STATES PATENT AND TRADEMARK OFFICE

CERTIFICATE OF CORRECTION

PATENT NO. : 6,740,482 B1
DATED : May 25, 2004
INVENTOR(S) : Benjamin T. Chen et al.

It is certified that error appears in the above-identified patent and that said Letters Patent is hereby corrected as shown below:

Column 33,
Line 50, "$Z_1S_{O2}SM_1$" change to -- $Z_1SO_2SM_1$ --
Line 55, "Mis" change to -- $M_1$ is --

Column 34,
Line 57, "M1" change to -- $M_1$ --

Signed and Sealed this

Fifth Day of April, 2005

JON W. DUDAS
*Director of the United States Patent and Trademark Office*